US012319977B2

(12) United States Patent
Oka et al.

(10) Patent No.: US 12,319,977 B2
(45) Date of Patent: Jun. 3, 2025

(54) HOT ROLLED STEEL SHEET AND PRODUCTION METHOD THEREOF

(71) Applicant: NIPPON STEEL CORPORATION, Tokyo (JP)

(72) Inventors: Masaharu Oka, Tokyo (JP); Nobusato Kojima, Tokyo (JP); Mitsuru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 534 days.

(21) Appl. No.: 17/788,672

(22) PCT Filed: Jan. 29, 2021

(86) PCT No.: PCT/JP2021/003289
§ 371 (c)(1),
(2) Date: Jun. 23, 2022

(87) PCT Pub. No.: WO2021/153746
PCT Pub. Date: Aug. 5, 2021

(65) Prior Publication Data

US 2023/0034898 A1 Feb. 2, 2023

(30) Foreign Application Priority Data

Jan. 30, 2020 (JP) ..... 2020-013713
Mar. 18, 2020 (JP) ..... 2020-047558

(51) Int. Cl.

| | |
|---|---|
| ***C21D 9/46*** | (2006.01) |
| ***B21C 47/02*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 2/04*** | (2006.01) |

(52) U.S. Cl.
CPC ..... *C21D 8/0226* (2013.01); *B21C 47/02* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C23C 2/04* (2013.01); *C21D 2211/001* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | |
|---|---|---|---|
| 2020/0224294 | A1 | 7/2020 | Hirashima et al. |
| 2021/0062289 | A1 | 3/2021 | Hirashima et al. |
| 2021/0140005 | A1 | 5/2021 | Yoshida et al. |

FOREIGN PATENT DOCUMENTS

| | | | |
|---|---|---|---|
| JP | 2011-52321 | A | 3/2011 |
| JP | 2014-47414 | A | 3/2014 |
| JP | 5609383 | B2 | 10/2014 |
| JP | 2017-179540 | A | 10/2017 |
| JP | 6477570 | B2 | 3/2019 |
| WO | WO 2019/009410 | A1 | 1/2019 |
| WO | WO 2019/031583 | A1 | 2/2019 |
| WO | WO 2019/216269 | A1 | 11/2019 |

OTHER PUBLICATIONS

Wilson, "Effect of Calcium and Magnesium Treatment on Steel Weldability," Welding Journal, vol. 61. No. 6, Jun. 1982, pp. 182s-188s, XP001263485.

*Primary Examiner* — Jophy S. Koshy
(74) *Attorney, Agent, or Firm* — Birch, Stewart, Kolasch & Birch, LLP

(57) ABSTRACT

A hot-rolled steel sheet has a predetermined chemical composition in which a microstructure includes 99% or more of martensite by volume fraction and a remainder in microstructure including residual austenite and ferrite, in a cross section parallel to a rolling direction, an average aspect ratio of prior austenite grains is less than 3.0, a proportion of sulfides having an aspect ratio of more than 3.0 among sulfides having an area of 1.0 $\mu m^2$ or more is 1.0% or, less, in a thickness middle portion, and a pole density of {211}<011> orientation is 3.0 or less, and a tensile strength TS is 980 MPa or higher.

20 Claims, No Drawings

HOT ROLLED STEEL SHEET AND PRODUCTION METHOD THEREOF

TECHNICAL FIELD OF THE INVENTION

The present invention relates to a hot-rolled steel sheet and a method for manufacturing the same.

Priority is claimed on Japanese Patent Application No. 2020-013713, filed on Jan. 30, 2020 and Japanese Patent Application No. 2020-047558, filed on Mar. 18, 2020, the contents of which are incorporated herein by reference.

RELATED ART

Recently, as a countermeasure against environmental problems, reduction in the weight of a vehicle has been desired in order to reduce carbon dioxide emissions and fuel consumption. In addition, requests for improvement of collision safety have increased. In order to achieve reduction in the weight of a vehicle or improvement of collision safety, high-strengthening of steel is an effective means. However, typically, when steel is high-strengthened, formability such as ductility, hole expansibility or toughness deteriorates. Therefore, a steel sheet having high strength and high formability or toughness at the same time is required.

In order to satisfy such requirements, for example, Patent Document 1 discloses a hot-rolled steel sheet and a method of manufacturing the same, the hot-rolled steel sheet including, by mass %: C: 0.08% to 0.25%; Si: 0.01% to 1.0%; Mn: 0.8% to 1.5%; P: 0.025% or less; S: 0.005% or less; Al: 0.005% to 0.1%; Nb: 0.001% to 0.05%; Ti: 0.001% to 0.05%; Mo: 0.1% to 1.0%; Cr: 0.1% to 1.0%; and B: 0.0005% to 0.005%, in which a volume percentage of martensite or tempered martensite as a primary phase is 90% or more, an aspect ratio of prior austenite is 3 to 18, a strength is high at a yield strength YS of 960 MPa or higher, and toughness is high at a vE-40 value of 40 J or higher.

In addition, as a method of reducing anisotropy of a hot-rolled steel sheet, for example, Patent Document 2 discloses a hot-rolled steel sheet and a method of manufacturing the same, the hot-rolled steel sheet including, by mass %: C: 0.04% to 0.15%; Si: 0.01% to 0.25%; Mn: 0.1% to 2.5%; P: 0.1% or less; S: 0.01% or less; Al: 0.005% to 0.05%; N: 0.01 or less; Ti: 0.01% to 0.12%; and B: 0.0003% to 0.005%, in which 90% or more of the structure is martensite, the amount of TiC precipitated is 0.05% or less, and a cleanliness of an A-type inclusion defined by JISG0202 is 0.01% or less.

PRIOR ART DOCUMENT

Patent Document

[Patent Document 1] Japanese Patent No. 5609383

[Patent Document 2] Japanese Unexamined Patent Application, First Publication No. 2014-47414

DISCLOSURE OF THE INVENTION

Problems to be Solved by the Invention

In the steel sheet of Patent Document 1, the aspect ratio of prior austenite is 3 or more, and there is a problem in that anisotropy in ductility or toughness is large. When the anisotropy is large, the application to a steel sheet for a vehicle is difficult, for example, because it is difficult to maintain member performance at a high level or the dimensional accuracy deteriorates after processing.

In addition, in the steel sheet of Patent Document 2, bending workability, yield strength, and anisotropy in toughness at −20° C. are reduced. However, the anisotropy in ductility is not reduced all the time. In addition, absorbed energy or anisotropy at −40° C. is not disclosed.

In this way, in the related art, it is difficult to obtain a hot-rolled steel sheet having high strength, excellent ductility, excellent low-temperature toughness, and little anisotropy in ductility or toughness.

The present invention has been made in order to solve the above-described problems, and an object thereof is to provide a hot-rolled steel sheet having high strength, excellent ductility, excellent low-temperature toughness, and little anisotropy in ductility or toughness, and a method of manufacturing the same. In addition, a preferable object of the present invention is to provide a hot-rolled steel sheet having high strength, excellent ductility, excellent low-temperature toughness, excellent hole expansibility, and little anisotropy in ductility or toughness, and a method of manufacturing the same.

Means for Solving the Problem

The present inventors conducted various investigations on a method of obtaining desired strength, ductility, toughness, and hole expansibility and reducing anisotropy after dissolving and hot rolling in a laboratory for various steels having different C contents, different Si contents, and different Mn contents. As a result, they found that, in order to obtain excellent ductility and excellent low-temperature toughness and to reduce anisotropy in ductility or toughness while securing a high tensile strength of 980 MPa or higher, it is important to reduce structure anisotropy and to reduce shape anisotropy of sulfides. Specifically, they found that the following configurations are important: 1) the structure includes 99% or more of martensite (including fresh martensite and tempered martensite); 2) an average aspect ratio of prior austenite grains in a cross section parallel to a rolling direction is less than 3.0; 3) a proportion of sulfides having an aspect ratio of more than 3.0 among sulfides having an area of 1.0 $\mu m^2$ or more in the cross section parallel to the rolling direction is 1.0% or less; and 4) in a thickness middle portion, a pole density of {211}<011> orientation is 3.0 or less.

In addition, the present inventors found that hole expansibility can be further improved by reducing ΔHv as a difference between a maximum value and a minimum value of Vickers hardness in a cross section perpendicular to the rolling direction.

The present invention has been made based on the above-described findings. The summary of the present invention is as follows.

[1] According to one aspect of the present invention, there is provided a hot-rolled steel sheet including, as a chemical composition, by mass %: C: 0.08% to 0.25%; Si: 0.01% to 1.00%; Mn: 0.8% to 2.0%; P: 0.020% or less; S: 0.001% to 0.010%; Al: 0.005% to 1.000%; N: 0.0010% to 0.0100%; Ti: 0.005% to 0.30%; Ca: 0.0005% to 0.0100%; Nb: 0% to 0.30%; V: 0% to 0.50%; Cr: 0% to 3.0%; Mo: 0% to 3.0%; Ni: 0% to 5.0%; Cu: 0% to 3.0%; B: 0% to 0.0100%; Mg: 0% to 0.0100%; Zr: 0% to 0.0500%; REM: 0% to 0.050%; and a remainder including Fe and impurities, in which a microstructure includes 99% or more of martensite by volume fraction and a remainder in microstructure including residual austenite and ferrite, in a cross section parallel to a rolling direction, an average aspect ratio of prior austenite grains is less than 3.0, a proportion of sulfides having an aspect ratio of more than 3.0 among sulfides having an area of 1.0 $\mu m^2$ or more is 1.0% or less, in a thickness middle portion, and a pole density of {211}<011> orientation is 3.0 or less, and a tensile strength TS is 980 MPa or higher.

[2] In the hot-rolled steel sheet according to [1], the tensile strength TS may be 1180 MPa or higher.

[3] In the hot-rolled steel sheet according to [2], a volume fraction of tempered martensite may be less than 5%.

[4] In the hot-rolled steel sheet according to [1], in a cross section perpendicular to the rolling direction, a difference ΔHv between a maximum value and a minimum value of Vickers hardness may be 50 or less.

[5] In the hot-rolled steel sheet according to [4], a volume fraction of fresh martensite may be less than 3%.

[6] The hot-rolled steel sheet according to any one of [1] to [5] may further include a galvanized layer on a surface.

[7] In the hot-rolled steel sheet according to [6], the galvanized layer may be a galvannealed layer.

[8] In the hot-rolled steel sheet according to any one of [1] to [7], the chemical composition may include, by mass %, one kind or two or more kinds selected from the group consisting of: Nb: 0.005% to 0.30%; V: 0.01% to 0.50%; Cr: 0.05% to 3.0%; Mo: 0.05% to 3.0%; Ni: 0.05% to 5.0%; Cu: 0.10% to 3.0%; B: 0.0003% to 0.0100%; Mg: 0.0005% to 0.0100%; Zr: 0.0010% to 0.0500%; and REM: 0.0010% to 0.050%.

[9] According to still another aspect of the present invention, there is provided a method of manufacturing the hot-rolled steel sheet according to any one of [1] to [3], including: a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities; a hot rolling process of hot-rolling the cast slab after the heating process to obtain a hot-rolled steel sheet; and a coiling process of coiling the hot-rolled steel sheet after the hot rolling process in a temperature range of 100° C. or lower, in which, in the hot rolling process, the cast slab is rolled such that a finish rolling temperature is 1000° C. or higher, first cooling is performed such that cooling starts within 0.10 seconds after completion of the rolling and a temperature decrease at an average cooling rate of 100° C./sec or faster is 50° C. or higher, light reduction rolling where a rolling reduction is 5% or more and 20% or less is performed at a temperature of an Ar3 transformation point or higher after the first cooling, and second cooling is performed such that an average cooling rate from completion of the light reduction rolling to 200° C. or lower is 50° C./sec or faster.

[10] According to still another aspect of the present invention, there is provided a method of manufacturing the hot-rolled steel sheet according to [4] or [5], including: a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities; a hot rolling process of hot-rolling the cast slab after the heating process to obtain a hot-rolled steel sheet; a coiling process of coiling the hot-rolled steel sheet after the hot rolling process in a temperature range of 100° C. or lower; a temper rolling process of performing temper rolling at an elongation ratio of 0.7% or more on the hot-rolled steel sheet after the coiling process; a tempering process of performing tempering where the hot-rolled steel sheet is heated up to 430° C. to 560° C. after the temper rolling, in which, in the hot rolling process, the cast slab is rolled such that a finish rolling temperature is 1000° C. or higher, first cooling is performed such that cooling starts within 0.10 seconds after completion of the rolling and a temperature decrease at an average cooling rate of 100° C./sec or faster is 50° C. or higher, light reduction rolling where a rolling reduction is 5% or more and 20% or less is performed at a temperature of an Ar3 transformation point or higher after the first cooling, and second cooling is performed such that an average cooling rate from completion of the light reduction rolling to 200° C. or lower is 50° C./sec or faster.

[11] According to still another aspect of the present invention, there is provided a method of manufacturing the hot-rolled steel sheet according to [6], including: a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities; a hot rolling process of hot-rolling the cast slab after the heating process to obtain a hot-rolled steel sheet; a coiling process of coiling the hot-rolled steel sheet after the hot rolling process in a temperature range of 100° C. or lower; a temper rolling process of performing temper rolling at an elongation ratio of 0.7% or more on the hot-rolled steel sheet after the coiling process; and a galvanizing process of performing Ni pre-plating on the hot-rolled steel sheet, heating the hot-rolled steel sheet up to 430° C. to 480° C. at a temperature rising rate of 20° C./sec or faster, and galvanizing the hot-rolled steel sheet, in which, in the hot rolling process, the cast slab is rolled such that a finish rolling temperature is 1000° C. or higher, first cooling is performed such that cooling starts within 0.10 seconds after completion of the rolling and a temperature decrease at an average cooling rate of 100° C./sec or faster is 50° C. or higher, light reduction rolling where a rolling reduction is 5% or more and 20% or less is performed at a temperature of an Ar3 transformation point or higher after the first cooling, and second cooling is performed such that an average cooling rate from completion of the light reduction rolling to 200° C. or lower is 50° C./sec or faster.

[12] According to still another aspect of the present invention, there is provided a method of manufacturing the hot-rolled steel sheet according to [7], including: a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities; a hot rolling process of hot-rolling the cast slab after the heating process to obtain a hot-rolled steel sheet; a coiling process of coiling the hot-rolled steel sheet after the hot rolling process in a temperature range of 100° C. or lower; a temper rolling process of performing temper rolling at an elongation ratio of 0.7% or more on the hot-rolled steel sheet after the coiling process; a galvanizing process of performing Ni pre-plating on the hot-rolled steel sheet, heating the hot-rolled steel sheet up to 430° C. to 480° C. at a temperature rising rate of 20° C./sec or faster, and galvanizing the hot-rolled steel sheet; and an alloying process of performing alloying at 470° C. to 560° C. for 10 seconds to 40 seconds after the galvanizing process, in which, in the hot rolling process, the cast slab is rolled such that a finish rolling temperature is 1000° C. or higher, first cooling is performed such that cooling starts within 0.10 seconds after completion of the rolling and a temperature decrease at an average cooling rate of 100° C./sec or faster is 50° C. or higher, light reduction rolling where a rolling reduction is 5% or more and 20% or less is performed at a temperature of an Ar3 transformation point or higher after the first cooling, and second cooling is performed such that an average cooling rate from completion of the light reduction rolling to 200° C. or lower is 50° C./sec or faster.

Effects of the Invention

In the above-described aspects according to the present invention, it is possible to provide a hot-rolled steel sheet having high strength, excellent ductility (elongation), excellent low-temperature toughness and little anisotropy in ductility or toughness, and a method of manufacturing the same. In addition, in a preferable aspect of the present invention, it is possible to provide a hot-rolled steel sheet having high strength, excellent ductility (elongation), excellent low-temperature toughness, excellent hole expansibility and little anisotropy in ductility or toughness, and a method of manufacturing the same. This hot-rolled steel sheet can be suitably applied to a vehicle component or the like and contributes to a reduction in the weight of a vehicle when applied to the vehicle component. Therefore, the contribution to the industry is remarkable.

EMBODIMENTS OF THE INVENTION

Hereinafter, a hot-rolled steel sheet according to an embodiment of the present invention (the hot-rolled steel sheet according to the embodiment) and a method of manufacturing the same will be described.

The hot-rolled steel sheet according to the embodiment includes, as a chemical composition, by mass %: C: 0.08% to 0.25%; Si: 0.01% to 1.00%; Mn: 0.8% to 2.0%; P: 0.020% or less; S: 0.001% to 0.010%; Al: 0.005% to 1.000%; N: 0.0010% to 0.0100%; Ti: 0.005% to 0.30%; and Ca: 0.0005% to 0.0100%; and optionally further including: Nb: 0.30% or less; V: 0.50% or less; Cr: 3.0% or less; Mo: 3.0% or less; Ni: 5.0% or less; Cu: 3.0% or less; B: 0.0100% or less; Mg: 0.0100% or less; Zr: 0.0500% or less; REM: 0.050% or less; and a remainder including Fe and impurities, in which a microstructure includes 99% or more of martensite by volume fraction and a remainder in microstructure including residual austenite and ferrite, in a cross section parallel to a rolling direction, an average aspect ratio of prior austenite grains is less than 3.0, a proportion of sulfides having an aspect ratio of more than 3.0 among sulfides having an area of 1.0 $\mu m^2$ or more is 1.0% or less, in a thickness middle portion, and a pole density of {211}<011> orientation is 3.0 or less, and a tensile strength (TS) is 980 MPa or higher.

Hereinafter, the hot-rolled steel sheet according to the embodiment will be described in detail.

First, the reason for limiting the range of each of the elements in the chemical composition of the hot-rolled steel sheet according to the embodiment will be described. Hereinafter, % in the content of each of the elements is mass %.

C: 0.08% to 0.25%

C is an element for increasing the strength of the steel. When the C content is less than 0.08%, it is difficult to ensure a tensile strength of 980 MPa or higher. Therefore, the C content is set to be 0.08% or more. The C content is preferably 0.10% or more.

On the other hand, when the C content is more than 0.25%, ductility, weldability, toughness, and the like deteriorate significantly. Therefore, the C content is set to be 0.25% or less. The C content is preferably 0.20% or less.

Si: 0.01% to 1.00%

Si is an element that is effective for increasing the strength of the steel by solid solution strengthening. In addition, Si is an element that is effective for suppressing the formation of cementite. When the Si content is less than 0.01%, these effects cannot be sufficiently obtained. Therefore, the Si content is set to be 0.01% or more.

On the other hand, when the Si content is more than 1.00%, the peelability of scale formed in hot rolling or chemical convertibility deteriorates significantly. In addition, there may be cases where a desired structure cannot be obtained. Therefore, the Si content is set to be 1.00% or less.

Mn: 0.8% to 2.0%

Mn is an element that is effective for improving the hardenability of the steel. When the Mn content is less than 0.8%, the effect of improving the hardenability cannot be sufficiently obtained. Therefore, the Mn content is set to be 0.8% or more.

On the other hand, when the Mn content is more than 2.0%, toughness deteriorates. Therefore, the Mn content is set to be 2.0% or less.

P: 0.020% or less

P is an impurity element that segregates in a grain boundary and decreases a grain boundary strength and toughness. Therefore, it is desirable to decrease the P content. The P content is set to be 0.020% or less in consideration of current refining techniques and manufacturing costs. The lower limit of the P content is not limited and the lower limit may be 0.001% in consideration of steelmaking costs.

S: 0.001% to 0.010%

S is an impurity element that deteriorates hot workability and toughness, and it is desirable to decrease the S content. The S content is set to be 0.010% or less in consideration of current refining techniques and manufacturing costs. The lower limit of the S content is set to be 0.001% in consideration of steelmaking costs. The lower limit of the S content is preferably 0.003%.

Al: 0.005% to 1.000%

Al is an element that is effective as a deoxidizing agent. In addition, Al is an element that forms AlN and contributes to suppressing the coarsening of crystal grains. When the Al content is less than 0.005%, these effects cannot be sufficiently obtained. Therefore, the Al content is 0.005% or more.

On the other hand, when the Al content is more than 1.000%, toughness deteriorates. Therefore, the Al content is set to be 1.000% or less.

N: 0.0010% to 0.0100%

N is an element that forms a nitride and contributes to suppressing the coarsening of crystal grains. When the N content is less than 0.0010%, the effect cannot be obtained. Therefore, the N content is set to be 0.0010% or more.

On the other hand, when the N content is more than 0.0100%, toughness deteriorates. Therefore, the N content is set to be 0.0100% or less.

Ti: 0.005% to 0.30%

Ti is an element that forms TiN and is effective for suppressing the coarsening of crystal grains. When the Ti content is less than 0.005%, the effect cannot be sufficiently obtained. Therefore, the Ti content is set to be 0.005% or more. The Ti content is preferably 0.01% or more.

On the other hand, when the Ti content is more than 0.30%, TiN coarsens and toughness deteriorates. Therefore, the Ti content is set to be 0.30% or less.

Ca: 0.0005% to 0.0100%

Ca is an element that is effective for suppressing deterioration in hot workability or toughness by S by controlling the morphology of a sulfide. When the Ca content is less than 0.0005%, the effect cannot be sufficiently obtained. Therefore, the Ca content is set to be 0.0005% or more.

On the other hand, even when an excess amount of Ca is included, the effect reaches saturation and the costs also increase. Therefore, the Ca content is 0.0100% or less.

The above-described elements are base elements of the hot-rolled steel sheet according to the embodiment, and the remainder other than the above-described elements typically includes Fe and impurities. Depending on a desired strength level or other required properties, the hot-rolled steel sheet according to the embodiment may further include one kind or two or more kinds selected from the group consisting of Cr, Mo, Ni, Cu, Nb, V, B, Mg, Zr, and REM. Since the hot-rolled steel sheet according to the embodiment can obtain the effect even without including the optional elements, the lower limit of the content of the optional elements is 0%. In the embodiment, the impurities are elements which are incorporated from raw materials such as ore or scrap or incorporated in manufacturing environments, and the elements are allowed within a range where there is no adverse effect on the hot-rolled steel sheet according to the embodiment. Hereinafter, the above-described optional elements will be described in detail.

Nb: 0% to 0.30%

Nb is an element for forming a fine carbonitride and is effective for suppressing the coarsening of crystal grains. Therefore, Nb may be included. In order to improve toughness by suppressing the coarsening of crystal grains, the Nb content is preferably 0.005% or more.

On the other hand, when the Nb content is excessively high, precipitates may coarsen and toughness may deteriorate. Therefore, when Nb is included, the Nb content is preferably 0.30% or less.

V: 0% to 0.50%

Like Nb, V is an element which forms a fine carbonitride. Therefore, V may be included. In order to improve toughness by suppressing the coarsening of crystal grains, the V content is preferably 0.01% or more.

On the other hand, when the V content is more than 0.50%, toughness may deteriorate. Therefore, when V is included, the V content is preferably 0.50% or less.

Cr: 0% to 3.0%

Mo: 0% to 3.0%

Ni: 0% to 5.0%

Cu: 0% to 3.0%

Cr, Mo, Ni, and Cu are elements that are effective for improving ductility and toughness. Therefore, Cr, Mo, Ni, and Cu may be included. In order to improve ductility and toughness, the Cr content is preferably 0.05% or more, the Mo content is preferably 0.05% or more, the Ni content is preferably 0.05% or more, and the Cu content is preferably 0.1% or more. The Cr content is more preferably 0.1% or more, the Mo content is more preferably 0.1% or more, the Ni content is more preferably 0.1% or more, and the Cu content is more preferably 0.2% or more.

On the other hand, when each of the Cr content, the Mo content, and the Cu content is more than 3.0% and the Ni content is more than 5.0%, toughness may deteriorate due to an increase in strength. When Cr, Mo, Ni, and Cu are included, the Cr content is preferably 3.0% or less, the Mo content is preferably 3.0% or less, the Ni content is preferably 5.0% or less, and the Cu content is preferably 3.0% or less.

B: 0% to 0.0100%

B is an element that segregates in a grain boundary and suppresses boundary segregation of P and S. In addition, B is also an element that is effective for improving the hardenability of the steel. Therefore, B may be included. In order to improve ductility, toughness, and hot workability by grain boundary strengthening or to improve hardenability, the B content is preferably set to be 0.0003% or more.

On the other hand, when the B content is more than 0.0100%, a coarse precipitate is formed in a grain boundary, which causes hot workability and toughness to deteriorate. Accordingly, when B is included, the B content is preferably 0.0100% or less.

Mg: 0% to 0.0100%

Zr: 0% to 0.0500%

REM: 0% to 0.050%

Mg, Zr, and REM are elements that are effective for suppressing deterioration in hot workability or toughness by S by controlling the morphology of a sulfide. Therefore, Mg, Zr, and REM may be included. In order to improve toughness, the Mg content is preferably 0.0005% or more, the Zr content is preferably 0.0010% or more, and the REM content is preferably 0.001% or more.

On the other hand, even when Mg, Zr, and/or REM is excessively included, the effect reaches saturation. Therefore, when Mg, Zr, and REM are included, the Mg content is preferably 0.0100% or less, the Zr content is preferably 0.0500% or less, and the REM content is preferably 0.050% or less.

Here, REM is any of 17 elements in total including Sc, Y, and lanthanoids, and the REM content is the total content of these elements. The lanthanoids are added industrially in the form of mischmetal.

The content of each of the elements in the hot-rolled steel sheet according to the embodiment can be obtained using a well-known method such as ICP-atomic emission spectrometry.

Next, the microstructure of the hot-rolled steel sheet according to the embodiment will be described.

<Microstructure Includes 99% or more of Martensite by Volume Fraction and Remainder in Microstructure Including Residual Austenite and Ferrite>

In the hot-rolled steel sheet according to the embodiment, in order to increase the uniformity of the structure and to reduce anisotropy, the microstructure includes 99% or more of martensite (including fresh martensite and tempered martensite) by volume fraction and a remainder in microstructure including residual austenite and ferrite.

Residual austenite and ferrite are different in the distribution state in a rolling direction and a direction perpendicular to the rolling direction. Therefore, when the volume fractions of the residual austenite and the ferrite increase, anisotropy increases. Therefore, the total volume fraction of these needs to be 1% or less, and the volume fraction of the martensite structure which is homogeneous needs to be 99% or more.

Fresh martensite is formed during cooling after hot rolling. In addition, tempered martensite is formed when fresh martensite is tempered through a subsequent heat treatment (heating in a tempering process or a plating process).

In order to increase the strength, it is preferable to reduce the volume fraction of tempered martensite in martensite such that fresh martensite is a main structure. For example, when the tensile strength is 1180 MPa or higher, it is desirable for the area fraction of tempered martensite to be less than 5%.

On the other hand, in order to improve the uniformity of the structure to improve hole expansibility, it is preferable to reduce the volume fraction of fresh martensite in martensite such that tempered martensite is a main structure. For example, the area fraction of fresh martensite is preferably less than 3%.

The volume fraction of each of the structures in the microstructure is obtained using the following method.

First, a sample is collected from a center portion of the hot-rolled steel sheet in a sheet width direction such that a cross section parallel to a rolling direction is a section to be observed.

In order to obtain the area fractions of martensite (including fresh martensite and tempered martensite) and ferrite, a structure at a ¼ thickness position of the section to be observed (rolling direction section) from the surface in a sheet thickness direction (in the case of a plated steel sheet, a ¼ thickness position from an interface between the plated layer and base metal in the sheet thickness direction of the steel sheet as the base metal) is made to appear by Le Pera etching or Nital etching and is observed with an optical microscope, an SEM, or a TEM. Next, each of the phases is determined by microstructural morphology, a precipitation state of a carbide, dislocation density, and the like, and the area fraction of each of the phases is measured using an image analyzer. The obtained area fraction of each of the phases is considered the volume fraction.

In the embodiment, fresh martensite and tempered martensite do not need to be distinguished from each other. When fresh martensite and tempered martensite need to be distinguished from each other, fresh martensite and tempered martensite can be distinguished from each other based on Vickers hardness (Hv) and C concentration (mass %). The Vickers hardness (HvM) of martensite is obtained by measuring the Vickers hardness at three points in martensite grains at a test force of 5 gf according to JIS Z 2244:2009 and calculating the average value of the Vickers hardness values. Next, the C concentration (CM: mass %) of the martensite is measured.

In the embodiment, cementite is present in martensite grains, and the concentration including the C concentration of cementite is considered the C concentration of the martensite. The C concentration (CM) of martensite is obtained by measuring the C concentration at a pitch of 0.5 μm or less using an electron probe microanalyzer (EPMA) attached to an FE-SEM and calculating the average value of the obtained C concentrations. Tempered martensite and fresh martensite are distinguished from each other based on the obtained Vickers hardness (HvM) and the C concentration (CM) of martensite. Specifically, when the obtained HvM and CM satisfy the following Expression 1, the martensite is identified as tempered martensite. When the obtained HvM and CM do not satisfy the following Expression 1, the martensite is identified as fresh martensite.

$$HvM/(-982.1\times CM^2+1676\times CM+189)\leq 0.60 \quad \text{Expression 1}$$

The value $(-982.1\times CM^2+1676\times CM+189)$ obtained by substituting the C concentration (CM) of martensite into the denominator of left part of Expression 1 represents the hardness of the original martensite having the C concentration. Tempered martensite in the metallographic structure of the hot-rolled steel sheet according to the embodiment is a structure formed when martensite that is formed during cooling after hot-rolling is tempered through a subsequent heat treatment, and the hardness decreases to be lower than that of the original martensite by cementite precipitation in the tempered martensite grains. On the other hand, fresh martensite in the hot-rolled steel sheet according to the embodiment is a structure formed when austenite remaining until cooling after hot rolling is transformed into martensite in the process of cooling in the subsequent heat treatment, the structure is not tempered, and the hardness thereof is close to that of the original martensite. Therefore, in the embodiment, by obtaining a ratio between the hardness of the original martensite and the actually measured hardness of the martensite, tempered martensite and fresh martensite are distinguished from each other.

In addition, the volume fraction of the residual austenite is obtained using the following method.

First, a sample is collected from a center portion of the steel sheet in a sheet width direction such that a cross section parallel to the sheet surface is a section to be observed. The surface of the sample was ground up to a ¼ thickness position (in the case of a plated steel sheet, a ¼ thickness position of the base steel sheet from an interface between the plated layer and base metal) and was chemically polished. Next, by X-ray diffraction using a Mo bulb, an intensity ratio between a diffraction intensity Iα(200) of (200) of ferrite, a diffraction intensity Iα{211} of {211} of ferrite, a diffraction intensity $I_\gamma$ (220) of (200) of austenite, and a diffraction intensity $I_\gamma$ (311) of (311) of austenite was obtained based on the following Expression, and the volume fraction of residual austenite is obtained based on the intensity ratio. In the following expression, $V_\gamma$ represents the volume fraction of residual austenite.

$$V\gamma=0.25\times\{I\gamma(220)/(1.35\times I\alpha(200)+I\gamma(220))+I\gamma(220)/(0.69\times I\alpha\{211\}+I\gamma(220))+I\gamma(311)/(1.5\times I\alpha(200)+I\gamma(311))+I\gamma(311)/(0.69\times I\alpha\{211\}+I\gamma(311))\}$$

<Average Aspect Ratio of Prior Austenite Grains: Less than 3.0>

In the hot-rolled steel sheet according to the embodiment, an average aspect ratio of prior austenite grains in a cross section parallel to the rolling direction is less than 3.0. When the average aspect ratio of prior austenite grains is 3.0 or more, the anisotropy in ductility or toughness increases.

<Prior Austenite Grain Size: 12 μm or More and 100 μm or Less>

In the hot-rolled steel sheet according to the embodiment, a grain size (prior γ grain size) of prior austenite grains in the cross section parallel to the rolling direction is preferably 12 μm or more and 100 μm or less.

When the prior austenite grain size is less than 12 μm, unrecrystallized grains are likely to remain, and deterioration in the uniformity of the structure is a concern. On the other hand, when the prior austenite grain size is more than 100 μm, low-temperature toughness deteriorates.

The average aspect ratio and the grain size of prior austenite grains are obtained using the following method.

First, a sample is collected from a center portion of the hot-rolled steel sheet in a sheet width direction such that a cross section parallel to a rolling direction is a section to be observed.

A structure at a ¼ thickness position of the section to be observed (rolling direction section) from the surface of the steel sheet is etched using an etchant (ethanol, 2% picric acid, 1% iron(II) chloride) to make a prior austenite grain boundary appear, and is observed with an optical microscope or a SEM. Using an image analyzer or the like, 100 or more prior austenite grains are observed, and the grain size and the aspect ratio of each of the prior austenite grains are measured. The average values of the grain sizes and the aspect ratios are considered as the prior austenite grain size and the average aspect ratio. Here, the aspect ratio of the prior austenite grain is (aspect ratio)=(major axis diameter in the rolling direction)/(minor axis diameter in the sheet thickness direction).

<Proportion of Sulfides Having Aspect Ratio of More than 3.0 Among Sulfides Having Area of 1.0 $\mu m^2$ or More Being 1.0% or Less>

When a proportion of the number of sulfides having an aspect ratio of more than 3.0 is more than 1.0%, among sulfides having an area of 1.0 $\mu m^2$ or more in the cross section parallel to the rolling direction, voids initiate from the sulfides as a starting point, and the anisotropy in ductility or toughness increases. In addition, when sulfides having a large aspect ratio are formed, a difference in Vickers hardness in a cross section perpendicular to the rolling direction also tends to increase. Therefore, in the hot-rolled steel sheet according to the embodiment, the proportion of the number of sulfides having an aspect ratio of more than 3.0 is set to be 1.0% or less among the sulfides having an area of 1.0 $\mu m^2$ or more in the cross section parallel to the rolling direction.

The reason for setting the sulfides having an area of 1.0 $\mu m^2$ or more to be target is that the sulfides having an area of less than 1.0 $\mu m^2$ are not likely to be a starting point of voids.

In the hot-rolled steel sheet according to the embodiment, examples of the sulfides include MnS, TiS, and CaS.

The proportion of the sulfides having an aspect ratio of more than 3.0 is obtained using the following method.

In the embodiment, sulfides are defined as inclusions having a mass fraction of S of 5% or more. Therefore, when the proportion of the sulfides having an aspect ratio of more than 3.0 is obtained, first, a sample is collected from a center portion of the hot-rolled steel sheet in a sheet width direction such that a cross section parallel to a rolling direction is a section to be observed. An as-polished structure at a ¼ thickness position of the section to be observed (rolling direction section) from the surface of the steel sheet is observed, the composition of each of inclusions is measured using an EDX attached to an SEM to identify a sulfide, and the area of the sulfide is measured using an image analyzer or the like. Regarding sulfides having an area of 1.0 $\mu m^2$ or more, the aspect ratios are measured. Regarding 1000 or more sulfides having an area of 1.0 $\mu m^2$ or more, the aspect ratios are measured using the above-described method, and the proportion of the number of sulfides having an aspect ratio of more than 3.0 is obtained. Here, the aspect ratio of the sulfide is (aspect ratio)=(major axis diameter in the rolling direction)/(minor axis diameter in the sheet thickness direction).

<In Thickness Middle Portion of Cross Section Parallel to Rolling Direction, Pole Density of {211}<011> Orientation: 3.0 or Less>

In the hot-rolled steel sheet according to the embodiment, in a thickness middle portion of the cross section parallel to the rolling direction, a pole density of {211}<011> orientation is 3.0 or less. When the hot-rolled steel sheet includes a texture where a pole density of {211}<011> orientation is more than 3.0, structure anisotropy increases, and anisotropy in ductility or toughness increases. The pole density is preferably 2.5 or less and more preferably 2.0 or less.

The pole density can be obtained from crystal orientation information by EBSD analysis and has the same definition as the X-ray random intensity ratio. Specifically, the pole density of {211}<011> orientation is obtained using the following method.

Using an apparatus in which a scanning electron microscope and an EBSD analyzer are combined and OIM analysis (registered trade name, manufactured by AMETEK Inc.), in the thickness middle portion (range of 1/10 thickness positions from a thickness center position in the front direction and the back direction of the steel sheet), fcc and bcc are distinguished from each other by EBSD analysis, orientation information of 1000 or more bcc crystal grains is measured, and the pole density of {211}<011> orientation is obtained by ODF analysis using harmonic series expansion.

<Difference ΔHv Between Maximum Value and Minimum Value of Vickers Hardness: 70 or Less>

In the hot-rolled steel sheet according to the embodiment, in the cross section perpendicular to the rolling direction, a difference ΔHv (Hvmax−Hvmin) between a maximum value (Hvmax) and a minimum value (Hvmin) of Vickers hardness is preferably 70 or less. When ΔHv increases, stress concentrates on a boundary between a soft portion having a low Vickers hardness and a hard portion having a high Vickers hardness under an external force load and thus initiation and propagation of cracks are promoted, and the hole expansibility of the hot-rolled steel sheet may deteriorate. In order to obtain excellent hole expansibility, ΔHv is more preferably 50 or less.

The difference ΔHv between a maximum value and a minimum value of Vickers hardness is measured using the following method.

First, a test piece is collected from a center portion of the hot-rolled steel sheet in the sheet width direction such that a cross section perpendicular to the rolling direction is a measurement surface. Regarding the obtained test piece, a Vickers hardness test is performed at a test force of 5 gf according to JIS Z 2244:2009. The Vickers hardness is measured at a pitch of 0.05 mm up to a ½ thickness position from the surface of the steel sheet in the cross section perpendicular to the rolling direction. In this method, the Vickers hardness test is performed on at least three test pieces. By calculating the average value of the maximum values of Vickers hardness of the test pieces, Hvmax is obtained. In addition, by calculating the average value of the minimum values of Vickers hardness of the test pieces, Hvmin is obtained. By subtracting the obtained Hvmin from the obtained Hvmax, ΔHv (Hvmax−Hvmin) is obtained.

<Tensile Strength: 980 MPa or Higher>

In consideration of contribution to a reduction in the weight of a vehicle, it is assumed that the hot-rolled steel sheet according to the embodiment is a high strength steel sheet having a tensile strength of 980 MPa or higher. The tensile strength is preferably 990 MPa or higher, more preferably 1080 MPa or higher, and still more preferably 1180 MPa or higher.

There is no need for an upper limit of the tensile strength, but when the tensile strength increases, a decrease in elongation is a concern. Therefore, the tensile strength may be set to be 1470 MPa or lower. Alternatively, the tensile strength may be set to be 1270 MPa or lower.

In addition, in the hot-rolled steel sheet according to the embodiment, a target of the product TS×λ of the tensile strength (TS) and a hole expansion ratio (λ) is 38000 MPa % or more. TS×λ is more preferably 40000 MPa % or more and still more preferably 50000 MPa % or more.

The tensile strength (TS) is obtained from a stress-strain curve that is obtained by performing a tensile test according to JIS Z 2241:2011 on a JIS No. 5 test piece which is cut from the hot-rolled steel sheet such that a longitudinal direction is parallel to or perpendicular to the rolling direction of the hot-rolled steel sheet. In addition, the hole expansion ratio is measured by performing a hole expansion test according to JIS Z 2256:2010.

<Galvanized Layer>

The hot-rolled steel sheet according to the embodiment may include a galvanized layer on the surface.

The galvanized layer in the hot-rolled steel sheet according to the embodiment may be a galvanized layer (hot-dip galvanized layer) formed by hot-dip galvanizing or may be a galvannealed layer formed by alloying the galvanized layer.

The galvanized layer in the hot-rolled steel sheet according to the embodiment preferably includes less than 7.0 mass % of Fe and 0.5 g/m$^2$ to 2.0 g/m$^2$ of Ni. In addition, when the galvanized layer is a galvannealed layer, the galvannealed layer preferably includes 7.0 mass % to 15.0 mass % of Fe and 0.5 g/m$^2$ to 2.0 g/m$^2$ of Ni. In the embodiment, a preferable range of the Fe content in the galvanized layer varies between a case where alloying is not performed and a case where alloying is performed.

Fe Content: Less than 7.0 mass % or 7.0 mass % to 15.0 mass %

First, the case where alloying is performed will be described. By alloying the galvanized steel sheet including the galvanized layer on the surface, the plated layer is alloyed, and spot weldability and coatability are further improved. Specifically, by dipping the steel sheet in a hot-dip galvanizing bath and alloying the steel sheet, Fe is incorporated into the galvanized layer, the Fe concentration in the galvanized layer is 7.0 mass % or more, and a hot-dip galvannealed steel sheet having excellent spot weldability and coatability can be obtained. On the other hand, when the Fe content is more than 15.0 mass %, the adhesion of the galvanized layer deteriorates, and the galvanized layer fractures and peels, and then is attached to a die during processing, which forms defects on the galvanized steel sheet. Accordingly, the Fe content in the galvannealed layer obtained by alloying is preferably in a range of 7.0 mass % to 15.0 mass %. The Fe content is more preferably 8.0 mass % or more or 14.0 mass % or less.

In the case where alloying is not performed, the Fe content in the galvanized layer is preferably less than 7.0 mass %. Even when the Fe content in the galvanized layer is less than 7.0 mass %, the galvanized steel sheet has excellent corrosion resistance, formability, and hole expansibility. The lower limit of the Fe content in the galvanized layer in the case where alloying is not performed is not particularly limited and may be 1.0 mass % in the real operation. When alloying is not performed, economy and manufacturability are excellent.

Ni Content: 0.5 g/m$^2$ to 2.0 g/m$^2$

The galvanized layer (including the galvannealed layer) in the hot-rolled steel sheet according to the embodiment preferably includes 0.5 g/m$^2$ to 2.0 g/m$^2$ of Ni. When the Ni content in the galvanized layer is less than 0.5 g/m$^2$ or more than 2.0 g/m$^2$, there may be cases where excellent adhesion and the alloying promotion effect cannot be sufficiently obtained.

The Ni content in the plated layer can be adjusted by Ni pre-plating.

Al Content: 0.1 mass % to 1.0 mass %

In order to control the alloying reaction in the galvanizing bath, Al is added to the galvanizing bath. Therefore, the galvanized layer includes a small amount of Al. When the Al content in the galvanized layer is less than 0.1 mass % or more than 1.0 mass %, the alloying reaction in the galvanizing bath cannot be controlled, and there may be cases where the galvanized layer cannot be appropriately alloyed. Therefore, the Al content in the galvanized layer is preferably 0.1 mass % to 1.0 mass %.

The Fe content and the Al content in the galvanized layer are obtained by removing the galvanized layer by dissolving it with a 5% HCl aqueous solution to which an inhibitor is added and measuring the Fe content and the Al content (mass %) in the solution by ICP. The Ni content (g/m$^2$) in the galvanized layer is obtained by measuring the Ni content (mass %) in the galvanized layer using the same method as described above and measuring the adhesion amount (g/m$^2$) of plating of galvanization.

The adhesion amount of plating of the galvanized layer according to the embodiment is not particularly limited, and the adhesion amount per single surface is preferably 5 g/m$^2$ or more from the viewpoint of corrosion resistance.

Even when upper plating is performed on the galvanized steel sheet according to the embodiment in order to further improve coatability and weldability or when various treatments such as a chromate treatment, a phosphate treatment, a lubricity improving treatment, or a weldability improving treatment are performed, the galvanized steel sheet does not deviate from the range of the present invention.

Next, the reason for limiting the manufacturing conditions will be described.

The hot-rolled steel sheet according to the embodiment can be manufactured using a manufacturing method including the following processes:

(I) a heating process of heating a cast slab having a predetermined chemical composition to 1350° C. or higher and 1400° C. or lower directly or after being temporarily cooled, (II) a hot rolling process of hot-rolling the cast slab after the heating process to obtain a hot-rolled steel sheet and (III) a coiling process of coiling the hot-rolled steel sheet after the hot rolling process in a temperature range of 100° C. or lower.

In addition, in order to further reduce ΔHv in the cross section perpendicular to the rolling direction, the manufacturing method preferably further includes the following processes:

(IV) a temper rolling process of performing temper rolling at an elongation ratio of 0.7% or more on the hot-rolled steel sheet after the coiling process and (V) a tempering process of performing tempering where heating is performed up to 430° C. to 560° C. after the temper rolling In order to obtain the galvanized steel sheet where the galvanized layer is provided on the surface of the hot-rolled steel sheet, the following process (V') is preferably performed instead of the process (V):

(V') a hot-dip galvanizing process of performing Ni pre-plating on the hot-rolled steel sheet, heating the hot-rolled steel sheet up to 430° C. to 480° C. at a temperature rising rate of 20° C./sec or faster, and performing hot-dip galvanizing.

In addition, in order to change galvanized layer on the surface of the hot-rolled steel sheet to the galvannealed layer, the following process (VI) is preferably performed after the process (V'):

(VI) an alloying process of performing alloying on the hot-rolled steel sheet including the galvanized layer at 470° C. to 560° C. for 10 seconds to 40 seconds.

Hereinafter, preferable conditions of each of the processes will be described.

During the manufacturing of the hot-rolled steel sheet according to the embodiment, manufacturing processes before the heating process are not particularly limited. That is, after melting using a blast furnace or an electric furnace, various secondary refining processes may be performed, and casting may be performed using a method such as typical continuous casting, casting by an ingot method, or thin slab casting. During continuous casting, a cast slab may be temporarily cooled to a low temperature, heated again, and hot-rolled. A cast slab may be cast and hot-rolled as it is without being cooled to a low temperature. As the raw material, scrap may be used.

<Heating Process>

In the heating process, the cast slab is heated to 1350° C. or higher and 1400° C. or lower directly or after being temporarily cooled.

When the heating temperature is lower than 1350° C., an undissolved sulfide remains due to insufficient dissolution of the sulfide. This sulfide extends in the rolling direction during hot rolling and causes an increase in anisotropy. Therefore, the heating temperature is set to be 1350° C. or higher. The heating temperature is preferably higher than 1350° C.

On the other hand, when the heating temperature is higher than 1400° C., formation of scale is significant, the surface properties deteriorate, and crystal grains coarsens, resulting in deterioration of the strength of the hot-rolled steel sheet or low-temperature toughness. Therefore, the heating temperature is set to be 1400° C. or lower.

<Hot Rolling Process>

<Coiling Process>

In the hot rolling process, the cast slab is rolled such that a finish rolling temperature is 1000° C. or higher, and cooling (first cooling) starts within 0.10 seconds after completion of the rolling. The first cooling is performed such that a temperature decrease at an average cooling rate of 100° C./sec or faster is 50° C. or higher.

Light reduction rolling where a rolling reduction is 5% or more and 20% or less is performed at a temperature of an Ar3 transformation point or higher after the first cooling. Next, second cooling is performed such that an average cooling rate from completion of the light reduction rolling to a cooling stop temperature of 200° C. or lower is 50° C./sec or faster. As a result, the hot-rolled steel sheet is formed from the slab.

When the finish rolling temperature is lower than 1000° C., a texture develops, which increases the anisotropy of the structure. Therefore, the finish rolling temperature is set to be 1000° C. or higher.

On the other hand, when the finish rolling temperature is higher than 1100° C., crystal grains coarsen. Therefore, the finish temperature is preferably 1100° C. or lower.

When an elapsed time until the start of cooling after finish rolling (time from the completion of finish rolling to the start of cooling) is longer than 0.10 seconds, the average cooling rate of the first cooling is slower than 100° C./sec, or the temperature decrease by cooling is lower than 50° C., a desired sulfide cannot be obtained and toughness deteriorates. Therefore, during the first cooling, cooling starts within 0.10 seconds after finish rolling and a temperature decrease at an average cooling rate of 100° C./sec or faster is 50° C. or higher (the temperature decrease is 50° C. or higher). After the first cooling, the light reduction rolling is performed at the Ar3 transformation point or higher. Therefore, the cooling stop temperature is preferably the Ar3 transformation point or higher. There is no need for an upper limit of the average cooling rate in the first cooling, but it may be set to be 1000° C./sec or slower in consideration of facility or the like.

When cooling starts within 0.10 seconds after finish rolling, for example, a method of performing cooling using a cooling apparatus between stands of a tandem rolling mill may be used.

In the embodiment, sulfides are made to finely precipitate due to the light reduction rolling described below. When sulfides precipitate before the light reduction rolling process, the sulfides are stretched by the rolling reduction such that the aspect ratio increases. Therefore, the rolling and the first cooling are controlled such that sulfides do not precipitate before the light reduction rolling process.

In the method of manufacturing the hot-rolled steel sheet according to the embodiment, after completion of the first cooling, sulfides are made to finely precipitate. Therefore, rolling (light reduction rolling) where a rolling reduction is 5% or more and 20% or less is performed at a temperature of an Ar3 transformation point or higher.

When the light reduction rolling temperature is lower than the Ar3 transformation point, ferrite is formed. Accordingly, the light reduction rolling temperature is the Ar3 transformation point or higher in order to suppress the formation of ferrite. In addition, when the rolling reduction of the light reduction rolling is less than 5%, the effect of precipitating sulfides finely cannot be sufficiently obtained. When the rolling reduction is more than 20%, the anisotropy increases. Therefore, the rolling reduction of the light reduction rolling is set to be 5% or more and 20% or less.

Here, the Ar3 transformation point can be measured using a fully automated transformation recording measurement apparatus (manufactured by Fuji Electronic Industrial Co., Ltd.) or the like by heating a test piece having a predetermined shape at 950° C. for 30 minutes, cooling the test piece at a rate of 30° C./sec, and measuring an expansion curve.

After the light reduction rolling, cooling is performed to a coiling temperature such that an average cooling rate from a light reduction rolling completion temperature to 200° C. or lower is 50° C./sec or higher, and coiling is performed in a temperature range of 100° C. or lower. When the cooling rate from the rolling completion temperature to 200° C. or lower is slower than 50° C./sec or the coiling temperature (cooling stop temperature) is higher than 100° C., a large amount of residual austenite, ferrite, or bainite is formed, and the volume fraction of martensite cannot be made to be 99% or more.

<Temper Rolling Process>

After coiling, temper rolling may be performed in order to correct the shape of the steel sheet, to prevent yield point elongation, and to homogenize the hardness distribution in the sheet thickness direction. From the viewpoint of correcting the shape and preventing yield point elongation, the elongation ratio is preferably 0.2% or more. In addition, from the viewpoint of homogenizing the hardness distribution in the sheet thickness direction, the elongation ratio is preferably 0.7% or more. When the elongation ratio is less than 0.7%, the effect cannot be sufficiently obtained. On the other hand, when the elongation ratio is more than 3.0%, the yield ratio significantly increases, and the elongation deteriorates. Therefore, when the temper rolling is performed, the elongation ratio is set to be preferably 3.0% or less.

The elongation ratio during the temper rolling can be obtained from, for example, a difference between a rotation speed of an entry side pay-off reel and a rotation speed of an exit side tension reel.

<Pickling Process>

Optionally, in order to remove scale formed during hot rolling, pickling may be performed after hot rolling or temper rolling. When pickling is performed, pickling conditions may be well-known conditions.

<Tempering Process>

In the hot-rolled steel sheet according to the embodiment, when ΔHv is controlled to be 50 or less and the galvanized layer is not formed, it is preferable to perform tempering where heating is performed up to a temperature range of 430° C. to 560° C. after performing the temper rolling or after performing the temper rolling and the pickling.

When the heating temperature is lower than 430° C., a desired structure cannot be obtained due to insufficient tempering. On the other hand, when the heating temperature is higher than 560° C., residual austenite is decomposed to form ferrite and cementite, the metallographic structure of the finally obtained steel sheet is inhomogeneous, and the hardness distribution in the sheet thickness direction is inhomogeneous.

<Galvanizing Process>

In the hot-rolled steel sheet according to the embodiment, when ΔHv is controlled to be 50 or less and the galvanized layer is formed on the surface, the galvanizing process is performed instead of the tempering process after performing the temper rolling or after performing the temper rolling and the pickling. In the galvanizing process, the galvanized steel sheet is obtained by performing Ni pre-plating on the hot-rolled steel sheet, heating the hot-rolled steel sheet up to a temperature range of 430° C. to 480° C. at an average temperature rising rate of 20° C./sec or faster, and performing galvanizing, for example, in a hot-dip galvanizing bath. The temperature described here is the surface temperature of the steel sheet.

When the average temperature rising rate before performing hot-dip galvanizing is slower than 20° C./sec, strain introduced by temper rolling is alleviated, and the alloying promotion effect cannot be obtained. When the heating temperature before performing hot-dip galvanizing is lower than 430° C., bare spots may occur during hot-dip galvanizing. When the heating temperature before performing hot-dip galvanizing is higher than 480° C., strain introduced by temper rolling is alleviated, and the alloying promotion effect cannot be obtained. In addition, the tensile strength may decrease. When alloying is not performed, press formability, weldability, and coating corrosion resistance are poorer than those when alloying is performed.

A method of Ni pre-plating may be any one of electroplating, dipping, or spray coating, and the adhesion amount of plating is preferably about 1.0 g/m$^2$ to 4.0 g/m$^2$. When Ni pre-plating is not performed, the alloying promotion effect cannot be obtained, and the alloying temperature needs to be increased. In the galvanized steel sheet, the hole expansibility improving effect cannot be obtained.

<Alloying Process>

Optionally, the hot-rolled steel sheet after galvanizing may be alloyed (galvannealed) by being held at in a temperature range of 470° C. to 560° C. for 10 seconds to 40 seconds. As a result, the Fe concentration in the galvanized layer can be set to be 7.0 mass % or more, and the spot weldability and coatability of the galvanized steel sheet can be further improved. When the temperature during alloying is lower than 470° C., alloying is insufficient. When the temperature during alloying is higher than 560° C., residual austenite is decomposed to form cementite, a desired microstructure cannot be obtained, and ductility and strength deteriorate. In addition, there may be cases where sufficient hole expansibility cannot be obtained. The time during alloying is determined depending on a balance with the alloying temperature and is desirably in a range of 10 seconds to 40 seconds. When the time for which alloying is performed is shorter than 10 seconds, alloying is not likely to progress. When the time for which alloying is performed is longer than 40 seconds, residual austenite is decomposed to form cementite, a desired microstructure cannot be obtained, and there may be cases where a sufficient hole expansibility improving effect cannot be obtained.

In order to correct the shape of the finally obtained hot-rolled steel sheet and to prevent yield point elongation, temper rolling where an elongation ratio is 0.2% to 1.0% may be further performed after the tempering process, the galvanizing process, or the alloying process. When the elongation ratio is less than 0.2%, the above-described effect cannot be sufficiently obtained. When the elongation ratio is more than 1.0%, the yield ratio significantly increases, and the elongation deteriorates.

EXAMPLES

Hereinafter, the effects of the present invention will be described in more detail using examples. These examples are merely exemplary in order to verify the effects of the present invention and do not limit the present invention.

Steels having chemical compositions shown in Tables 1-1 and 1-2 were cast, and heating, rolling, first cooling, light reduction rolling, second cooling, and coiling were performed under conditions shown in Tables 2-1, 2-2, 4-1, 4-2, 6-1 to 6-4. In Tables 6-1 to 6-4, the heating temperatures are the heating temperatures of the cast pieces, and the rolling completion temperatures are the finish temperatures of hot rolling before the first cooling.

Next, regarding Nos. 1 to 24 in Tables 2-1 and 2-2, temper rolling, Ni pre-plating, hot-dip galvanizing, and alloying were performed under conditions shown in Table 2-2. As a result, galvanized hot-rolled steel sheets (hot-dip galvannealed hot-rolled steel sheets) shown in Tables 3-1 and 3-2 were obtained.

In addition, regarding Nos. 25 to 46 in Tables 4-1 and 4-2, temper rolling, Ni pre-plating, and hot-dip galvanizing (on both surfaces; 45 g/m$^2$ per single surface) were performed under conditions shown in Tables 4-1 and 4-2. As a result, galvanized hot-rolled steel sheets (hot-dip galvanized hot-rolled steel sheets) shown in Tables 5-1 and 5-2 were obtained.

In addition, regarding Nos. 47 to 88 in Tables 6-1 and 6-4, temper rolling and tempering were performed on some steel sheets under conditions shown in Tables 6-1 to 6-4. As a result, hot-rolled steel sheets (non-galvanized hot-rolled steel sheets) shown in Tables 7-1 to 7-4 were obtained.

In both the galvanized hot-rolled steel sheets and the hot-rolled steel sheets that were finally obtained, the sheet thickness values were 5.0 mm. In both the galvanized hot-rolled steel sheets and the hot-rolled steel sheets that were finally obtained, the prior austenite grain sizes were in a range of 12 μm or more and 100 μm or less except for No. 13, No. 37, No. 59, and No. 81. In No. 13, No. 37, No. 59, and No. 81, the prior austenite grain sizes were more than 100 μm.

In the obtained hot-dip galvanized hot-rolled steel sheet or the obtained hot-rolled steel sheet, the microstructural fractions of martensite (including fresh martensite and tempered martensite), residual austenite, ferrite, and other structures, the average aspect ratio of prior austenite grain, the prior austenite grain size, the proportion of sulfides having an aspect ratio of more than 3.0 among sulfides having an area of 1.0 $\mu m^2$ or more, the pole density of {211}<011> orientation, the difference ΔHv between a maximum value and a minimum value of Vickers hardness, the Fe content, the Ni content, and the Al content in the galvanized layer were evaluated using the above-described method.

In addition, regarding mechanical properties, JIS No. 5 tensile test pieces were collected from an L direction (rolling direction) and a C direction (direction perpendicular to the rolling direction) to perform a tensile test according to JIS Z 2241:2011. Using a stress-strain curve of the tensile test, a tensile strength (TS) and total elongation (EL) were obtained.

Toughness was evaluated by collecting V-notch Charpy test pieces having a subsize of 5 mm width (×10 mm×55 mm length) from the L direction and the C direction and performing a Charpy test according to JIS Z 2242:2018.

When the tensile strength (the L direction and the C direction) was 980 MPa or higher, the total elongation was 10.0% or more, and the Charpy absorbed energy (vE-40° C.) at −40° C. (the L direction and the C direction) were 50 $J/cm^2$ or more, it was determined that the steel sheet had high strength, excellent ductility, and excellent toughness.

In addition, when the product of the tensile strength (TS) in the C direction and the hole expansion ratio (λ) satisfied TS (MPa)×λ(%)≥38000 MP·%, it was determined that the steel sheet had excellent hole expansibility. When TS (MPa)×λ(%)≥40000 MP·%, it was determined that the steel sheet had excellent hole expansibility.

In addition, when a ratio (the value in the L direction/the value in the C direction) of the characteristic value in the L direction to the characteristic value in the C direction was 0.90 or more and 1.10 or less, it was determined that anisotropy was low.

Regarding the external appearance of the plating, whether or not bare spots occurred was determined by visual inspection. When bare spots were not observed by visual inspection, the plated steel sheet was determined to have excellent plating external appearance and was evaluated as "Pass". When bare spots were observed, the plated steel sheet was determined to have poor practicability and was evaluated as "Fail".

Regarding the adhesion of the galvanized layer, a sample on which a cupping test (punch diameter: 40 mm, blank holder force (BHF): 1 ton, drawing ratio: 2.0) was performed was degreased with a solvent, a tape was peeled off from the side surface, and the degree of blackening of the tape was measured. The degree of blackening was obtained by measuring the luminosity (L value) and obtaining a difference from the L value of a blank tape. A case where the degree of blackening was less than 30% was determined as "Pass" and is shown as "OK" in the field of adhesion in the table. A case where the degree of blackening was 30% or more was determined as "Fail" and is shown as "NG" in the field of adhesion in the table.

The results are shown in Tables 3-1, 3-2, 5-1, 5-2, and 7-1 to 7-4.

The Fe content shown in Tables 3-2 and 5-2 represents the Fe content in the galvanized layer. In the hot-dip galvannealed steel sheets (Examples) in Tables 3-1 and 3-2 that were alloyed, the Fe contents were 7.0 mass % to 15.0 mass %, which shows that alloying progressed sufficiently. In the hot-dip galvanized steel sheets (Examples) in Tables 5-1 and 5-2 that were not alloyed, the Fe contents were less than 7.0 mass %.

TABLE 1-1

| Steel | Chemical composition (mass %), remainder: Fe and impurities | | | | | | | | |
|---|---|---|---|---|---|---|---|---|---|
| No. | C | Si | Mn | P | S | Al | N | Ti | Ca |
| A1 | 0.11 | 0.50 | 1.9 | 0.007 | 0.003 | 0.040 | 0.0023 | 0.01 | 0.0032 |
| B1 | 0.12 | 0.30 | 1.8 | 0.005 | 0.006 | 0.030 | 0.0035 | 0.13 | 0.0025 |
| C1 | 0.14 | 0.04 | 2.0 | 0.012 | 0.005 | 0.060 | 0.0028 | 0.16 | 0.0029 |
| D1 | 0.16 | 0.40 | 1.3 | 0.006 | 0.004 | 0.210 | 0.0042 | 0.03 | 0.0065 |
| E1 | 0.22 | 0.30 | 1.1 | 0.015 | 0.005 | 0.007 | 0.0021 | 0.01 | 0.0037 |
| F1 | 0.14 | 0.90 | 1.8 | 0.009 | 0.003 | 0.150 | 0.0038 | 0.02 | 0.0018 |
| A2 | 0.09 | 0.30 | 1.8 | 0.005 | 0.003 | 0.030 | 0.0030 | 0.01 | 0.0025 |
| B2 | 0.10 | 0.20 | 1.7 | 0.008 | 0.005 | 0.040 | 0.0026 | 0.11 | 0.0038 |
| C2 | 0.12 | 0.03 | 1.8 | 0.006 | 0.004 | 0.050 | 0.0023 | 0.17 | 0.0032 |
| D2 | 0.13 | 0.30 | 1.2 | 0.017 | 0.006 | 0.230 | 0.0045 | 0.03 | 0.0062 |
| E2 | 0.21 | 0.20 | 0.9 | 0.007 | 0.003 | 0.008 | 0.0031 | 0.02 | 0.0027 |
| F2 | 0.12 | 0.80 | 1.6 | 0.012 | 0.005 | 0.140 | 0.0036 | 0.01 | 0.0045 |
| G1 | 0.07 | 0.40 | 1.8 | 0.013 | 0.007 | 0.030 | 0.0032 | 0.03 | 0.0023 |
| H1 | 0.12 | 1.90 | 1.0 | 0.009 | 0.006 | 0.040 | 0.0045 | 0.06 | 0.0015 |
| I1 | 0.14 | 0.30 | 0.7 | 0.015 | 0.005 | 0.050 | 0.0036 | 0.01 | 0.0021 |
| J1 | 0.12 | 0.20 | 2.7 | 0.007 | 0.008 | 0.030 | 0.0041 | 0.02 | 0.0018 |
| K1 | 0.35 | 0.40 | 1.9 | 0.016 | 0.009 | 0.060 | 0.0035 | 0.03 | 0.0016 |
| G2 | 0.06 | 0.30 | 1.7 | 0.007 | 0.006 | 0.040 | 0.0028 | 0.02 | 0.0013 |
| H2 | 0.11 | 1.80 | 0.9 | 0.012 | 0.005 | 0.030 | 0.0035 | 0.05 | 0.0021 |
| I2 | 0.12 | 0.20 | 0.6 | 0.008 | 0.006 | 0.050 | 0.0031 | 0.01 | 0.0018 |
| J2 | 0.10 | 0.10 | 2.5 | 0.011 | 0.007 | 0.040 | 0.0047 | 0.03 | 0.0024 |
| K2 | 0.32 | 0.20 | 1.7 | 0.015 | 0.009 | 0.050 | 0.0032 | 0.01 | 0.0012 |

(Note)
An underline represents a condition outside of the range of the present invention.

TABLE 1-2

| Steel | Chemical composition (mass %), remainder: Fe and impurities | | | | | | | | | |
|---|---|---|---|---|---|---|---|---|---|---|
| No. | Nb | V | Cr | Mo | Ni | Cu | B | Mg | REM | Zr |
| A1 | | | | | | | | | | |
| B1 | 0.03 | | | | | | | | | |
| C1 | | 0.05 | | | | | 0.0013 | | | |

TABLE 1-2-continued

| Steel | Chemical composition (mass %), remainder: Fe and impurities | | | | | | | | | |
|---|---|---|---|---|---|---|---|---|---|---|
| No. | Nb | V | Cr | Mo | Ni | Cu | B | Mg | REM | Zr |
| D1 | | | 0.5 | | | | | 0.0032 | | |
| E1 | | | | 0.3 | | | | | 0.026 | |
| F1 | | | | | 0.1 | 0.2 | | | | 0.0034 |
| A2 | | | | 0.1 | | | 0.0012 | | | |
| B2 | | | | | | | 0.0015 | | | |
| C2 | | | | | 0.3 | | | 0.0025 | | |
| D2 | 0.03 | | | 0.5 | | | | | | |
| E2 | | 0.02 | 0.6 | | | | | | | 0.017 |
| F2 | | | | | 0.1 | 0.2 | | | 0.0038 | |
| G1 | | | | | | | | | | |
| H1 | | | 0.3 | | | | | | | |
| I1 | 0.01 | | | | | | | | | |
| J1 | | | | | | | | | 0.018 | |
| K1 | | | | | | | | | | |
| G2 | | | | | | | | | | |
| H2 | 0.01 | | | | | | | | | |
| I2 | | | | | | | | | 0.0023 | |
| J2 | | | 0.2 | | | | | | | |
| K2 | | | | | | | | | | |

(Note)
An underline represents a condition outside of the range of the present invention.

TABLE 2-1

| | | | | | First cooling | | | | Light reduction rolling. condition | |
|---|---|---|---|---|---|---|---|---|---|---|
| | | | Heating | Rolling | Time from finish | | | Temperature | | |
| No. | Steel No. | Ar3 (° C.) | Heating temperature (° C.) | Rolling finish temperature (° C.) | rolling completion temperature to start of cooling (s) | Average cooling rate (° C./s) | Cooling stop temperature (° C.) | decrease by cooling (° C.) | Rolling temperature (° C.) | Rolling reduction (%) |
| 1 | A1 | 721 | 1370 | 1030 | 0.07 | 130 | 900 | 130 | 880 | 7 |
| 2 | B1 | 720 | 1350 | 1010 | 0.05 | 150 | 940 | 70 | 920 | 11 |
| 3 | C1 | 693 | 1380 | 1070 | 0.09 | 100 | 950 | 120 | 920 | 5 |
| 4 | D1 | 726 | 1360 | 1050 | 0.07 | 160 | 900 | 150 | 880 | 18 |
| 5 | E1 | 733 | 1390 | 1060 | 0.10 | 120 | 920 | 140 | 890 | 14 |
| 6 | F1 | 711 | 1370 | 1020 | 0.08 | 170 | 910 | 110 | 880 | 6 |
| 21 | A1 | 721 | 1370 | 1040 | 0.08 | 120 | 920 | 120 | 900 | 6 |
| 7 | G1 | 741 | 1360 | 1040 | 0.09 | 110 | 950 | 90 | 930 | 6 |
| 8 | H1 | 801 | 1350 | 1060 | 0.08 | 130 | 990 | 70 | 960 | 9 |
| 9 | I1 | 791 | 1390 | 1050 | 0.10 | 120 | 990 | 60 | 970 | 7 |
| 10 | J1 | 654 | 1360 | 1030 | 0.07 | 110 | 920 | 110 | 900 | 18 |
| 11 | K1 | 631 | 1370 | 1010 | 0.06 | 130 | 880 | 130 | 860 | 17 |
| 12 | A1 | 721 | 1310 | 1030 | 0.08 | 110 | 940 | 90 | 910 | 12 |
| 13 | A1 | 721 | 1440 | 1110 | 0.09 | 100 | 1030 | 80 | 1010 | 5 |
| 14 | A1 | 721 | 1360 | 960 | 0.06 | 130 | 840 | 120 | 820 | 14 |
| 15 | A1 | 721 | 1370 | 1090 | 0.32 | 120 | 1020 | 70 | 1000 | 11 |
| 16 | A1 | 721 | 1350 | 1040 | 0.08 | 60 | 980 | 60 | 960 | 6 |
| 17 | A1 | 721 | 1360 | 1080 | 0.10 | 110 | 1050 | 30 | 1020 | 9 |
| 18 | A1 | 721 | 1380 | 1060 | 0.09 | 120 | 940 | 120 | 910 | 1 |
| 19 | A1 | 721 | 1370 | 1010 | 0.08 | 100 | 920 | 90 | 890 | 6 |
| 20 | A1 | 721 | 1360 | 1020 | 0.09 | 110 | 970 | 50 | 950 | 13 |
| 22 | A1 | 721 | 1360 | 1030 | 0.07 | 140 | 900 | 130 | 880 | 8 |
| 23 | A1 | 721 | 1380 | 1050 | 0.06 | 130 | 910 | 140 | 890 | 7 |
| 24 | A1 | 721 | 1360 | 1040 | 0.09 | 120 | 910 | 130 | 890 | 6 |

(Note)
An underline represents a condition outside of the range of the present invention.

TABLE 2-2

| No. | Second cooling Average cooling rate from light reduction rolling completion temperature to 200° C. or lower (° C./s) | Coiling conditions Coiling temperature (° C.) | Temper rolling Elongation (%) | Galvanization conditions Ni pre-plating ($g/m^2$) | Average temperature rising rate (° C./s) | Heating temperature (° C.) | Alloying temperature (° C.) | Alloying time (sec) | Note |
|---|---|---|---|---|---|---|---|---|---|
| 1 | 50 | 40 | 0.7 | 1.0 | 20 | 460 | 520 | 15 | Examples |
| 2 | 70 | 30 | 1.0 | 1.5 | 40 | 460 | 510 | 20 | |
| 3 | 60 | 50 | 0.8 | 1.1 | 30 | 440 | 530 | 15 | |
| 4 | 110 | 100 | 0.9 | 1.3 | 20 | 480 | 490 | 35 | |
| 5 | 60 | 60 | 1.2 | 1.2 | 30 | 460 | 550 | 15 | |
| 6 | 70 | 50 | 0.7 | 2.1 | 50 | 470 | 530 | 20 | |
| 21 | 60 | 30 | 0.3 | 1.2 | 25 | 460 | 520 | 15 | |
| 7 | 70 | 60 | 0.7 | 1.1 | 30 | 450 | 520 | 20 | Comparative examples |
| 8 | 60 | 80 | 0.8 | 1.0 | 20 | 460 | 530 | 15 | |
| 9 | 50 | 50 | 1.1 | 1.2 | 40 | 470 | 500 | 30 | |
| 10 | 60 | 70 | 0.9 | 1.0 | 30 | 460 | 520 | 20 | |
| 11 | 50 | 60 | 0.7 | 1.1 | 20 | 450 | 510 | 15 | |
| 12 | 60 | 80 | 0.8 | 1.0 | 30 | 460 | 540 | 10 | |
| 13 | 50 | 50 | 0.9 | 1.2 | 20 | 470 | 520 | 15 | |
| 14 | 80 | 60 | 0.7 | 1.1 | 20 | 460 | 530 | 25 | |
| 15 | 60 | 40 | 1.0 | 1.5 | 30 | 460 | 510 | 20 | |
| 16 | 50 | 60 | 0.8 | 1.2 | 20 | 450 | 520 | 15 | |
| 17 | 70 | 30 | 1.2 | 1.3 | 40 | 470 | 530 | 30 | |
| 18 | 60 | 100 | 1.1 | 1.0 | 30 | 460 | 540 | 25 | |
| 19 | 30 | 90 | 0.8 | 1.2 | 20 | 470 | 520 | 20 | |
| 20 | 60 | 200 | 0.7 | 1.1 | 30 | 460 | 510 | 15 | |
| 22 | 50 | 50 | 0.7 | None | 20 | 470 | 610 | 30 | |
| 23 | 60 | 40 | 0.8 | 1.0 | 15 | 460 | 600 | 40 | |
| 24 | 50 | 50 | 1.0 | 1.2 | 30 | 460 | 520 | 60 | |

(Note)
An underline represents a condition outside of the range of the present invention.

TABLE 3-1

| No. | Volume fraction of microstructures: Martensite (%) Fresh martensite (%) | Tempered martensite (%) | Total (%) | Residual austenite (%) | Ferrite (%) | Other (%) | Prior austenite grains Average aspect ratio | Sulfides Proportion of sulfides having aspect ratio of more than 3 among sulfides having area of 1 $\mu m^2$ | Texture Pole density of {211}<011> | ΔHv (Hv) |
|---|---|---|---|---|---|---|---|---|---|---|
| 1 | 0 | 99 | 99 | 1 | 0 | 0 | 1.2 | 0.8 | 1.7 | 48 |
| 2 | 0 | 100 | 100 | 0 | 0 | 0 | 1.6 | 0.6 | 2.3 | 45 |
| 3 | 1 | 99 | 100 | 0 | 0 | 0 | 1.3 | 0.7 | 1.9 | 49 |
| 4 | 0 | 99 | 99 | 0 | 1 | 0 | 2.1 | 0.8 | 1.8 | 46 |
| 5 | 2 | 97 | 99 | 1 | 0 | 0 | 1.7 | 0.7 | 2.6 | 47 |
| 6 | 0 | 100 | 100 | 0 | 0 | 0 | 1.5 | 0.9 | 1.7 | 50 |
| 21 | 0 | 100 | 100 | 0 | 0 | 0 | 1.3 | 0.9 | 1.8 | 81 |
| 7 | 0 | 87 | 87 | 0 | 9 | 4 | 1.9 | 0.8 | 1.9 | 118 |
| 8 | 0 | 77 | 77 | 3 | 14 | 6 | 2.3 | 0.7 | 3.8 | 109 |
| 9 | 0 | 69 | 69 | 1 | 11 | 19 | 1.5 | 0.9 | 4.7 | 98 |
| 10 | 0 | 100 | 100 | 0 | 0 | 0 | 2.4 | 26.2 | 3.5 | 95 |
| 11 | 0 | 96 | 96 | 4 | 0 | 0 | 2.2 | 1.3 | 2.3 | 105 |
| 12 | 0 | 99 | 99 | 1 | 0 | 0 | 1.1 | 14.5 | 1.6 | 98 |
| 13 | 0 | 99 | 99 | 1 | 0 | 0 | 1.2 | 0.7 | 1.8 | 89 |
| 14 | 0 | 99 | 99 | 1 | 0 | 0 | 3.2 | 0.8 | 5.1 | 96 |
| 15 | 0 | 99 | 99 | 1 | 0 | 0 | 1.2 | 4.5 | 2.5 | 75 |
| 16 | 0 | 99 | 99 | 1 | 0 | 0 | 1.4 | 3.7 | 2.3 | 89 |
| 17 | 0 | 99 | 99 | 1 | 0 | 0 | 1.3 | 3.9 | 2.0 | 100 |
| 18 | 0 | 99 | 99 | 0 | 0 | 0 | 1.1 | 14.7 | 1.3 | 95 |
| 19 | 0 | 53 | 53 | 3 | 23 | 21 | 1.4 | 0.7 | 3.7 | 129 |
| 20 | 0 | 94 | 94 | 1 | 2 | 3 | 1.3 | 1.5 | 3.4 | 105 |
| 22 | 0 | 98 | 98 | 0 | 1 | 1 | 1.2 | 0.8 | 2.0 | 64 |
| 23 | 0 | 98 | 98 | 0 | 1 | 1 | 1.4 | 0.7 | 1.9 | 63 |
| 24 | 0 | 98 | 98 | 0 | 1 | 1 | 1.3 | 0.8 | 1.8 | 69 |

(Note)
An underline represents failure.

TABLE 3-2

| | Mechanical properties | | | | | | | | | | | Galvanized layer | | | | | |
|---|---|---|---|---|---|---|---|---|---|---|---|---|---|---|---|---|---|
| | Tensile strength (TS) (MPa) | | | Total elongation (EL) (%) | | | vE-40° C.(J/cm$^2$) | | | Hole | | | Fe | Ni | Al | | |
| No. | L direction | C direction | TS(L)/TS(C) | L direction | C direction | EL(L)/EL(C) | L direction | C direction | vE-40° C.(L)/vE-40° C.(C) | expansion ratio (λ) | TS × λ (MPa · %) | Bare spots | content (mass %) | content (mass %) | content (mass %) | Adhesion | Note |
| 1 | 994 | 1006 | 0.99 | 13.9 | 13.7 | 1.01 | 87 | 84 | 1.04 | 60 | 60360 | None | 11.0 | 0.5 | 0.5 | OK | Examples |
| 2 | 1047 | 1092 | 0.96 | 12.5 | 12.1 | 1.03 | 74 | 72 | 1.03 | 55 | 60060 | None | 10.3 | 0.7 | 0.4 | OK | |
| 3 | 991 | 1011 | 0.98 | 12.2 | 12.0 | 1.02 | 78 | 75 | 1.04 | 61 | 61671 | None | 11.8 | 0.6 | 0.5 | OK | |
| 4 | 1155 | 1176 | 0.98 | 13.3 | 12.7 | 1.05 | 89 | 86 | 1.03 | 52 | 61152 | None | 7.9 | 0.7 | 0.3 | OK | |
| 5 | 1217 | 1233 | 0.99 | 11.8 | 11.4 | 1.04 | 73 | 70 | 1.04 | 47 | 57951 | None | 13.6 | 0.6 | 0.8 | OK | |
| 6 | 1022 | 1045 | 0.98 | 12.6 | 12.3 | 1.02 | 77 | 76 | 1.01 | 58 | 60610 | None | 12.8 | 1.2 | 0.6 | OK | |
| 21 | 990 | 996 | 0.99 | 13.8 | 13.6 | 1.01 | 85 | 82 | 1.04 | 40 | 39840 | None | 11.3 | 0.6 | 0.5 | OK | |
| 7 | 723 | 780 | 0.93 | 11.7 | 11.0 | 1.06 | 77 | 73 | 1.05 | 40 | 31200 | None | 11.6 | 0.6 | 0.5 | OK | Comparative examples |
| 8 | 768 | 887 | 0.87 | 12.3 | 11.0 | 1.12 | 74 | 60 | 1.23 | 37 | 32819 | None | 12.3 | 0.5 | 0.6 | OK | |
| 9 | 748 | 869 | 0.86 | 12.5 | 11.3 | 1.11 | 67 | 59 | 1.14 | 35 | 30415 | None | 8.6 | 0.6 | 0.3 | OK | |
| 10 | 991 | 1128 | 0.88 | 12.1 | 9.8 | 1.23 | 61 | 34 | 1.79 | 28 | 31584 | None | 11.2 | 0.5 | 0.5 | OK | |
| 11 | 1317 | 1437 | 0.92 | 10.9 | 9.9 | 1.10 | 60 | 49 | 1.22 | 22 | 31614 | None | 10.1 | 0.6 | 0.4 | OK | |
| 12 | 995 | 1005 | 0.99 | 13.6 | 11.9 | 1.14 | 82 | 73 | 1.12 | 31 | 31155 | None | 12.4 | 0.5 | 0.6 | OK | |
| 13 | 943 | 960 | 0.98 | 13.2 | 13.1 | 1.01 | 42 | 37 | 1.14 | 32 | 30720 | None | 11.5 | 0.6 | 0.5 | OK | |
| 14 | 995 | 1074 | 0.93 | 13.1 | 11.3 | 1.16 | 81 | 73 | 1.11 | 29 | 31146 | None | 12.7 | 0.6 | 0.6 | OK | |
| 15 | 973 | 994 | 0.98 | 13.7 | 13.0 | 1.05 | 64 | 48 | 1.33 | 32 | 31808 | None | 10.4 | 0.8 | 0.4 | OK | |
| 16 | 963 | 984 | 0.98 | 13.3 | 12.6 | 1.06 | 62 | 49 | 1.27 | 31 | 30504 | None | 11.1 | 0.6 | 0.5 | OK | |
| 17 | 973 | 995 | 0.98 | 13.1 | 12.5 | 1.05 | 49 | 38 | 1.29 | 33 | 32835 | None | 12.6 | 0.7 | 0.6 | OK | |
| 18 | 978 | 1001 | 0.98 | 13.7 | 12.1 | 1.13 | 84 | 59 | 1.42 | 31 | 31031 | None | 13.2 | 0.5 | 0.7 | OK | |
| 19 | 681 | 736 | 0.93 | 12.3 | 11.1 | 1.11 | 73 | 61 | 1.20 | 38 | 27968 | None | 11.5 | 0.6 | 0.5 | OK | |
| 20 | 832 | 891 | 0.93 | 11.4 | 10.3 | 1.11 | 74 | 63 | 1.17 | 35 | 31185 | None | 10.8 | 0.5 | 0.5 | OK | |
| 22 | 965 | 977 | 0.99 | 12.3 | 12.1 | 1.02 | 54 | 50 | 1.08 | 38 | 37126 | Present | 13.5 | 0.0 | 0.7 | NG | |
| 23 | 972 | 979 | 0.99 | 12.4 | 12.2 | 1.02 | 53 | 51 | 1.04 | 39 | 38181 | None | 12.8 | 0.5 | 0.6 | OK | |
| 24 | 981 | 988 | 0.99 | 12.1 | 11.9 | 1.02 | 51 | 50 | 1.02 | 38 | 37544 | None | 12.5 | 0.6 | 0.5 | OK | |

(Note)
An underline represents failure.

TABLE 4-1

| | | | Heating | Rolling | First cooling | | | | Light reduction rolling condition | |
|---|---|---|---|---|---|---|---|---|---|---|
| No. | Steel No. | Ar3 (° C.) | Heating temperature (° C.) | Rolling finish temperature (° C.) | Time from finish rolling completion temperature to start of'cooling (s) | Average cooling rate (° C./s) | Cooling stop temperature (° C.) | Temperature decrease by cooling (° C.) | Rolling temperature (° C.) | Rolling reduction (%) |
| 25 | A1 | 721 | 1370 | 1030 | 0.07 | 130 | 900 | 130 | 880 | 7 |
| 26 | B1 | 720 | 1350 | 1010 | 0.05 | 150 | 940 | 70 | 920 | 11 |
| 27 | C1 | 693 | 1380 | 1070 | 0.09 | 100 | 950 | 120 | 920 | 5 |
| 28 | D1 | 726 | 1360 | 1050 | 0.07 | 160 | 900 | 150 | 880 | 18 |
| 29 | E1 | 733 | 1390 | 1060 | 0.10 | 120 | 920 | 140 | 890 | 14 |
| 30 | F1 | 711 | 1370 | 1020 | 0.08 | 170 | 910 | 110 | 880 | 6 |
| 45 | A1 | 721 | 1370 | 1040 | 0.08 | 120 | 920 | 120 | 900 | 6 |
| 31 | G1 | 741 | 1360 | 1040 | 0.09 | 110 | 950 | 90 | 930 | 6 |
| 32 | H1 | 801 | 1350 | 1060 | 0.08 | 130 | 990 | 70 | 960 | 9 |
| 33 | I1 | 791 | 1390 | 1050 | 0.10 | 120 | 990 | 60 | 970 | 7 |
| 34 | J1 | 654 | 1360 | 1030 | 0.07 | 110 | 920 | 110 | 900 | 18 |
| 35 | K1 | 631 | 1370 | 1010 | 0.06 | 130 | 880 | 130 | 860 | 17 |
| 36 | A1 | 721 | 1310 | 1030 | 0.08 | 110 | 940 | 90 | 910 | 12 |
| 37 | A1 | 721 | 1440 | 1110 | 0.09 | 100 | 1030 | 80 | 1010 | 5 |
| 38 | A1 | 721 | 1360 | 960 | 0.06 | 130 | 840 | 120 | 820 | 14 |
| 39 | A1 | 721 | 1370 | 1090 | 0.32 | 120 | 1020 | 70 | 1000 | 11 |
| 40 | A1 | 721 | 1350 | 1040 | 0.08 | 60 | 980 | 60 | 960 | 6 |
| 41 | A1 | 721 | 1360 | 1080 | 0.10 | 110 | 1050 | 30 | 1020 | 9 |
| 42 | A1 | 721 | 1380 | 1060 | 0.09 | 120 | 940 | 120 | 910 | 1 |
| 43 | A1 | 721 | 1370 | 1010 | 0.08 | 100 | 920 | 90 | 890 | 6 |
| 44 | A1 | 721 | 1360 | 1020 | 0.09 | 110 | 970 | 50 | 950 | 13 |
| 46 | A1 | 721 | 1360 | 1030 | 0.07 | 140 | 900 | 130 | 880 | 8 |

(Note)
An underline represents a condition outside of the range of the present invention.

TABLE 4-2

| No. | Second cooling Average cooling rate from light reduction rolling completion temperature to 200° C. or lower (° C./s) | Coiling conditions Coiling temperature (° C.) | Temper rolling Elongation (%) | Galvanization conditions Ni pre-plating (g/m²) | Average temperature rising rate (° C./s) | Heating temperature (° C.) | Alloying temperature (° C.) | Alloying time (sec) | Note |
|---|---|---|---|---|---|---|---|---|---|
| 25 | 50 | 40 | 0.7 | 1.0 | 20 | 460 | — | — | Examples |
| 26 | 70 | 30 | 1.0 | 1.5 | 40 | 460 | — | — | |
| 27 | 60 | 50 | 0.8 | 1.1 | 30 | 440 | — | — | |
| 28 | 110 | 100 | 0.9 | 1.3 | 20 | 480 | — | — | |
| 29 | 60 | 60 | 1.2 | 1.2 | 30 | 460 | — | — | |
| 30 | 70 | 50 | 0.7 | 2.1 | 50 | 470 | — | — | |
| 45 | 60 | 30 | 0.3 | 1.2 | 25 | 460 | — | — | Comparative examples |
| 31 | 70 | 60 | 0.7 | 1.1 | 30 | 450 | — | — | |
| 32 | 60 | 80 | 0.8 | 1.0 | 20 | 460 | — | — | |
| 33 | 50 | 50 | 1.1 | 1.2 | 40 | 470 | — | — | |
| 34 | 60 | 70 | 0.9 | 1.0 | 30 | 460 | — | — | |
| 35 | 50 | 60 | 0.7 | 1.1 | 20 | 450 | — | — | |
| 36 | 60 | 80 | 0.8 | 1.0 | 30 | 460 | — | — | |
| 37 | 50 | 50 | 0.9 | 1.2 | 20 | 470 | — | — | |
| 38 | 80 | 60 | 0.7 | 1.1 | 20 | 460 | — | — | |
| 39 | 60 | 40 | 1.0 | 1.5 | 30 | 460 | — | — | |
| 40 | 50 | 60 | 0.8 | 1.2 | 20 | 450 | — | — | |
| 41 | 70 | 30 | 1.2 | 1.3 | 40 | 470 | — | — | |
| 42 | 60 | 100 | 1.1 | 1.0 | 30 | 460 | — | — | |
| 43 | 30 | 90 | 0.8 | 1.2 | 20 | 470 | — | — | |
| 44 | 60 | 200 | 0.7 | 1.1 | 30 | 460 | — | — | |
| 46 | 50 | 50 | 0.7 | None | 20 | 470 | — | — | |

(Note)
An underline represents a condition outside of the range of the present invention.

TABLE 5-1

| No. | Volume fraction of microstructures: Martensite (%) Fresh martensite (%) | Tempered martensite (%) | Total (%) | Residual austenite (%) | Ferrite (%) | Other (%) | Prior austenite grains Average aspect ratio | Sulfides Proportion of sulfides having aspect ratio of more than 3 among sulfides having area of 1 μm² | Texture Pole density of {211}<011> | ΔHv (Hv) |
|---|---|---|---|---|---|---|---|---|---|---|
| 25 | 0 | 99 | 99 | 1 | 0 | 0 | 1.2 | 0.8 | 1.7 | 46 |
| 26 | 0 | 100 | 100 | 0 | 0 | 0 | 1.6 | 0.6 | 2.3 | 42 |
| 27 | 1 | 99 | 100 | 0 | 0 | 0 | 1.3 | 0.7 | 1.9 | 47 |
| 28 | 0 | 99 | 99 | 0 | 1 | 0 | 2.1 | 0.8 | 1.8 | 43 |
| 29 | 2 | 97 | 99 | 1 | 0 | 0 | 1.7 | 0.7 | 2.6 | 45 |
| 30 | 0 | 100 | 100 | 0 | 0 | 0 | 1.5 | 0.9 | 1.7 | 48 |
| 45 | 0 | 100 | 100 | 0 | 0 | 0 | 1.3 | 0.9 | 1.8 | 78 |
| 31 | 0 | 87 | 87 | 0 | 9 | 4 | 1.9 | 0.8 | 1.9 | 115 |
| 32 | 0 | 77 | 77 | 3 | 14 | 6 | 2.3 | 0.7 | 3.8 | 107 |
| 33 | 0 | 69 | 69 | 1 | 11 | 19 | 1.5 | 0.9 | 4.7 | 96 |
| 34 | 0 | 100 | 100 | 0 | 0 | 0 | 2.4 | 26.2 | 3.5 | 92 |
| 35 | 0 | 96 | 96 | 4 | 0 | 0 | 2.2 | 1.3 | 2.3 | 103 |
| 36 | 0 | 99 | 99 | 1 | 0 | 0 | 1.1 | 14.5 | 1.6 | 95 |
| 37 | 0 | 99 | 99 | 1 | 0 | 0 | 1.2 | 0.7 | 1.8 | 87 |
| 38 | 0 | 99 | 99 | 1 | 0 | 0 | 3.2 | 0.8 | 5.1 | 93 |
| 39 | 0 | 99 | 99 | 1 | 0 | 0 | 1.2 | 4.5 | 2.5 | 72 |
| 40 | 0 | 99 | 99 | 1 | 0 | 0 | 1.4 | 3.7 | 2.3 | 88 |
| 41 | 0 | 99 | 99 | 1 | 0 | 0 | 1.3 | 3.9 | 2.0 | 97 |
| 42 | 0 | 99 | 99 | 0 | 0 | 0 | 1.1 | 14.7 | 1.3 | 92 |
| 43 | 0 | 53 | 53 | 3 | 23 | 21 | 1.4 | 0.7 | 3.7 | 127 |
| 44 | 0 | 94 | 94 | 1 | 2 | 3 | 1.3 | 1.5 | 3.4 | 102 |
| 46 | 0 | 98 | 98 | 0 | 1 | 1 | 1.2 | 0.8 | 2.0 | 62 |

(Note)
An underline represents failure.

TABLE 5-2

| | Mechanical properties | | | | | | | | | | | | Galvanized layer | | | | |
|---|---|---|---|---|---|---|---|---|---|---|---|---|---|---|---|---|---|
| | Tensile Strength (TS) (MPa) | | | Total Elongation (EL) (%) | | | vE-40° C.(J/cm$^2$) | | | Hole | | | | Fe | Ni | Al | |
| No. | L direction | C direction | TS(L)/TS(C) | L direction | C direction | EL(L)/EL(C) | L direction | C direction | vE-40° C.(L)/vE-40° C.(C) | expansion ratio (λ) | TS × λ (MPa · %) | Bare spots | content (mass %) | content (mass %) | content (mass %) | Adhesion | Note |
| 25 | 1046 | 1056 | 0.99 | 13.4 | 13.2 | 1.02 | 82 | 79 | 1.04 | 56 | 59136 | None | 2.5 | 0.6 | 0.5 | OK | Examples |
| 26 | 1088 | 1133 | 0.96 | 12.1 | 11.7 | 1.03 | 70 | 68 | 1.03 | 50 | 56650 | None | 1.8 | 0.8 | 0.4 | OK | |
| 27 | 1043 | 1062 | 0.98 | 11.7 | 11.5 | 1.02 | 72 | 69 | 1.04 | 55 | 58410 | None | 1.9 | 0.6 | 0.6 | OK | |
| 28 | 1215 | 1235 | 0.98 | 12.9 | 12.4 | 1.04 | 84 | 82 | 1.02 | 48 | 59280 | None | 2.2 | 0.8 | 0.3 | OK | |
| 29 | 1257 | 1268 | 0.99 | 11.3 | 11.0 | 1.03 | 67 | 65 | 1.03 | 44 | 55792 | None | 1.2 | 0.7 | 0.8 | OK | |
| 30 | 1075 | 1098 | 0.98 | 12.1 | 11.8 | 1.03 | 71 | 69 | 1.03 | 53 | 58194 | None | 2.8 | 1.3 | 0.5 | OK | |
| 45 | 1043 | 1055 | 0.99 | 13.5 | 13.1 | 1.03 | 81 | 78 | 1.04 | 37 | 39035 | None | 2.1 | 0.6 | 0.5 | OK | |
| 31 | 775 | 835 | 0.93 | 11.2 | 10.6 | 1.06 | 73 | 69 | 1.06 | 36 | 30060 | None | 2.1 | 0.7 | 0.5 | OK | Comparative examples |
| 32 | 808 | 925 | 0.87 | 11.9 | 10.5 | 1.13 | 69 | 55 | 1.25 | 32 | 29600 | None | 1.8 | 0.6 | 0.7 | OK | |
| 33 | 808 | 927 | 0.87 | 12.1 | 11.0 | 1.10 | 62 | 55 | 1.13 | 31 | 28737 | None | 1.5 | 0.6 | 0.3 | OK | |
| 34 | 942 | 1179 | 0.80 | 11.6 | 9.3 | 1.25 | 56 | 31 | 1.81 | 24 | 28296 | None | 2.3 | 0.7 | 0.5 | OK | |
| 35 | 1365 | 1494 | 0.91 | 10.4 | 9.4 | 1.11 | 55 | 46 | 1.20 | 19 | 28386 | None | 1.9 | 0.7 | 0.4 | OK | |
| 36 | 1035 | 1047 | 0.99 | 13.1 | 11.5 | 1.14 | 75 | 67 | 1.12 | 28 | 29316 | None | 2.7 | 0.6 | 0.5 | OK | |
| 37 | 993 | 1010 | 0.98 | 12.8 | 12.7 | 1.01 | 38 | 32 | 1.19 | 29 | 29290 | None | 1.6 | 0.7 | 0.5 | OK | |
| 38 | 1053 | 1121 | 0.94 | 12.7 | 10.9 | 1.17 | 75 | 67 | 1.12 | 26 | 29146 | None | 2.0 | 0.8 | 0.6 | OK | |
| 39 | 1013 | 1032 | 0.98 | 13.2 | 12.6 | 1.05 | 59 | 43 | 1.37 | 28 | 28896 | None | 1.7 | 0.9 | 0.4 | OK | |
| 40 | 1013 | 1024 | 0.99 | 12.9 | 12.1 | 1.07 | 58 | 45 | 1.29 | 27 | 27648 | None | 2.6 | 0.7 | 0.5 | OK | |
| 41 | 1021 | 1047 | 0.98 | 12.6 | 12.0 | 1.05 | 45 | 33 | 1.36 | 30 | 31410 | None | 1.4 | 0.8 | 0.6 | OK | |
| 42 | 1035 | 1059 | 0.98 | 13.3 | 11.7 | 1.14 | 78 | 52 | 1.50 | 28 | 29652 | None | 1.3 | 0.6 | 0.7 | OK | |
| 43 | 735 | 790 | 0.93 | 11.9 | 10.7 | 1.11 | 68 | 55 | 1.24 | 33 | 26070 | None | 2.9 | 0.7 | 0.6 | OK | |
| 44 | 881 | 943 | 0.93 | 11.1 | 10.0 | 1.11 | 69 | 58 | 1.19 | 31 | 29233 | None | 1.5 | 0.6 | 0.5 | OK | |
| 46 | 1004 | 1015 | 0.99 | 11.9 | 11.8 | 1.01 | 50 | 46 | 1.09 | 35 | 35525 | None | 1.6 | 0.0 | 0.7 | NG | |

(Note)
An underline represents a condition outside of the range of the present invention.

TABLE 6-1

| | | | Heating | Rolling | First cooling | | | | Light reduction rolling condition | |
|---|---|---|---|---|---|---|---|---|---|---|
| No. | Steel No. | Ar3 (° C.) | Heating temperature (° C.) | Rolling finish temperature (° C.) | Time from finish rolling completion temperature to start of cooling (s) | Average cooling rate (° C./s) | Cooling stop temperature (° C.) | Temperature decrease by cooling (° C.) | Rolling temperature (° C.) | Rolling reduction (%) |
| 47 | A1 | 721 | 1370 | 1030 | 0.07 | 130 | 900 | 130 | 880 | 7 |
| 48 | B1 | 720 | 1350 | 1010 | 0.05 | 150 | 940 | 70 | 920 | 11 |
| 49 | C1 | 693 | 1380 | 1070 | 0.09 | 100 | 950 | 120 | 920 | 5 |
| 50 | D1 | 726 | 1360 | 1050 | 0.07 | 160 | 900 | 150 | 880 | 18 |
| 51 | E1 | 733 | 1390 | 1060 | 0.10 | 120 | 920 | 140 | 890 | 14 |
| 52 | F1 | 711 | 1370 | 1020 | 0.08 | 170 | 910 | 110 | 880 | 6 |
| 53 | G1 | 741 | 1360 | 1040 | 0.09 | 110 | 950 | 90 | 930 | 6 |
| 54 | H1 | 801 | 1350 | 1060 | 0.08 | 130 | 990 | 70 | 960 | 9 |
| 55 | I1 | 791 | 1390 | 1050 | 0.10 | 120 | 990 | 60 | 970 | 7 |
| 56 | J1 | 654 | 1360 | 1030 | 0.07 | 110 | 920 | 110 | 900 | 18 |
| 57 | K1 | 631 | 1370 | 1010 | 0.06 | 130 | 880 | 130 | 860 | 17 |
| 58 | A1 | 721 | 1310 | 1030 | 0.08 | 110 | 940 | 90 | 910 | 12 |
| 59 | A1 | 721 | 1440 | 1110 | 0.09 | 100 | 1030 | 80 | 1010 | 5 |
| 60 | A1 | 721 | 1360 | 960 | 0.06 | 130 | 840 | 120 | 820 | 14 |
| 61 | A1 | 721 | 1370 | 1090 | 0.32 | 120 | 1020 | 70 | 1000 | 11 |
| 62 | A1 | 721 | 1350 | 1040 | 0.08 | 60 | 980 | 60 | 960 | 6 |
| 63 | A1 | 721 | 1360 | 1080 | 0.10 | 110 | 1050 | 30 | 1020 | 9 |
| 64 | A1 | 721 | 1380 | 1060 | 0.09 | 120 | 940 | 120 | 910 | 1 |
| 65 | A1 | 721 | 1370 | 1010 | 0.08 | 100 | 920 | 90 | 890 | 6 |
| 66 | A1 | 721 | 1360 | 1020 | 0.09 | 110 | 970 | 50 | 950 | 13 |
| 67 | A1 | 721 | 1370 | 1040 | 0.08 | 120 | 920 | 120 | 900 | 6 |
| 68 | A1 | 721 | 1360 | 1030 | 0.07 | 140 | 900 | 130 | 880 | 8 |

(Note)
An underline represents a condition outside of the range of the present invention.

TABLE 6-2

| No. | Second cooling Average cooling rate from light reduction rolling completion temperature to 200° C. or lower (° C./s) | Coiling conditions Coiling temperature (° C.) | Temper rolling Elongation (%) | Tempering conditions Heating temperature (° C.) | Note |
|---|---|---|---|---|---|
| 47 | 50 | 40 | 0.7 | 520 | Examples |
| 48 | 70 | 30 | 1.0 | 510 | |
| 49 | 60 | 50 | 0.8 | 530 | |
| 50 | 110 | 100 | 0.9 | 490 | |
| 51 | 60 | 60 | 1.2 | 550 | |
| 52 | 70 | 50 | 0.7 | 530 | |
| 53 | 70 | 60 | 0.7 | 520 | Comparative examples |
| 54 | 60 | 80 | 0.8 | 530 | |
| 55 | 50 | 50 | 1.1 | 500 | |
| 56 | 60 | 70 | 0.9 | 520 | |
| 57 | 50 | 60 | 0.7 | 510 | |
| 58 | 60 | 80 | 0.8 | 540 | |
| 59 | 50 | 50 | 0.9 | 520 | |
| 60 | 80 | 60 | 0.7 | 530 | |
| 61 | 60 | 40 | 1.0 | 510 | |
| 62 | 50 | 60 | 0.8 | 520 | |
| 63 | 70 | 30 | 1.2 | 530 | |
| 64 | 60 | 100 | 1.1 | 540 | |
| 65 | 30 | 90 | 0.8 | 520 | |
| 66 | 60 | 200 | 0.7 | 510 | |
| 67 | 60 | 30 | 0.3 | 520 | |
| 68 | 50 | 50 | 0.7 | 610 | |

(Note)
An underline represents a condition outside of the range of the present invention.

TABLE 6-4

| No. | Second cooling Average cooling rate from light reduction rolling completion temperature to 200° C. or lower (° C./s) | Coiling conditions Coiling temperature (° C.) | Temper rolling Elongation (%) | Tempering conditions Heating temperature (° C.) | Note |
|---|---|---|---|---|---|
| 69 | 60 | 50 | — | — | Examples |
| 70 | 50 | 30 | — | — | |
| 71 | 70 | 70 | — | — | |
| 72 | 100 | 100 | — | — | |
| 73 | 80 | 50 | — | — | |
| 74 | 60 | 40 | — | — | |
| 75 | 60 | 50 | — | — | Comparative examples |
| 76 | 50 | 70 | — | — | |
| 77 | 70 | 60 | — | — | |
| 78 | 50 | 80 | — | — | |
| 79 | 50 | 50 | — | — | |
| 80 | 50 | 70 | — | — | |
| 81 | 60 | 60 | — | — | |
| 82 | 70 | 50 | — | — | |
| 83 | 50 | 30 | — | — | |
| 84 | 60 | 50 | — | — | |
| 85 | 50 | 40 | — | — | |
| 86 | 60 | 50 | — | — | |
| 87 | 20 | 100 | — | — | |
| 88 | 50 | 200 | — | — | |

(Note)
An underline represents a condition outside of the range of the present invention.

TABLE 6-3

| No. | Steel No. | Ar3 (° C.) | Heating: Heating temperature (° C.) | Rolling: Rolling finish temperature (° C.) | First cooling: Time from finish rolling completion temperature to start of cooling (s) | First cooling: Average cooling rate (° C./s) | First cooling: Cooling stop temperature (° C.) | First cooling: Temperature decrease by cooling (° C.) | Light reduction rolling condition: Rolling temperature (° C.) | Light reduction rolling condition: Rolling reduction (%) |
|---|---|---|---|---|---|---|---|---|---|---|
| 69 | A2 | 731 | 1360 | 1020 | 0.06 | 150 | 900 | 120 | 880 | 5 |
| 70 | B2 | 733 | 1370 | 1000 | 0.08 | 100 | 920 | 80 | 900 | 10 |
| 71 | C2 | 696 | 1360 | 1050 | 0.10 | 120 | 930 | 120 | 910 | 7 |
| 72 | D2 | 759 | 1390 | 1030 | 0.07 | 170 | 870 | 160 | 850 | 16 |
| 73 | E2 | 729 | 1360 | 1060 | 0.09 | 130 | 910 | 150 | 880 | 12 |
| 74 | F2 | 731 | 1350 | 1010 | 0.10 | 140 | 890 | 120 | 870 | 8 |
| 75 | G2 | 750 | 1370 | 1020 | 0.08 | 100 | 920 | 100 | 900 | 5 |
| 76 | H2 | 820 | 1380 | 1050 | 0.10 | 120 | 970 | 80 | 950 | 10 |
| 77 | I2 | 804 | 1360 | 1030 | 0.09 | 110 | 950 | 80 | 930 | 5 |
| 78 | J2 | 667 | 1350 | 1010 | 0.08 | 100 | 910 | 100 | 890 | 15 |
| 79 | K2 | 652 | 1350 | 1040 | 0.08 | 120 | 900 | 140 | 860 | 20 |
| 80 | A2 | 731 | 1320 | 1020 | 0.09 | 100 | 920 | 100 | 900 | 10 |
| 81 | A2 | 731 | 1430 | 1100 | 0.10 | 110 | 1020 | 80 | 1000 | 5 |
| 82 | A2 | 731 | 1350 | 970 | 0.05 | 150 | 870 | 100 | 840 | 15 |
| 83 | A2 | 731 | 1360 | 1080 | 0.30 | 100 | 1040 | 60 | 1020 | 10 |
| 84 | A2 | 731 | 1350 | 1060 | 0.10 | 70 | 1010 | 50 | 990 | 8 |
| 85 | A2 | 731 | 1370 | 1070 | 0.09 | 100 | 1050 | 20 | 1030 | 10 |
| 86 | A2 | 731 | 1370 | 1050 | 0.10 | 100 | 950 | 100 | 930 | 2 |
| 87 | A2 | 731 | 1350 | 1020 | 0.09 | 120 | 910 | 110 | 890 | 5 |
| 88 | A2 | 731 | 1350 | 1000 | 0.10 | 100 | 950 | 50 | 920 | 15 |

(Note)
An underline represents a condition outside of the range of the present invention.

TABLE 7-1

| No. | Volume fraction of microstructures: Martensite (%): Fresh martensite (%) | Martensite (%): Tempered martensite (%) | Martensite (%): Total (%) | Residual austenite (%) | Ferrite (%) | Other (%) | Prior austenite grains: Average aspect ratio | Sulfides: Proportion of sulfides having aspect ratio of more than 3 among sulfides having area of 1 μm² | Texture: Pole density of {211}<011> | ΔHv (Hv) |
|---|---|---|---|---|---|---|---|---|---|---|
| 47 | 0 | 99 | 99 | 1 | 0 | 0 | 1.2 | 0.8 | 1.7 | 45 |
| 48 | 0 | 100 | 100 | 0 | 0 | 0 | 1.6 | 0.6 | 2.3 | 43 |
| 49 | 1 | 99 | 100 | 0 | 0 | 0 | 1.3 | 0.7 | 1.9 | 46 |
| 50 | 0 | 99 | 99 | 0 | 1 | 0 | 2.1 | 0.8 | 1.8 | 45 |
| 51 | 2 | 97 | 99 | 1 | 0 | 0 | 1.7 | 0.7 | 2.6 | 44 |
| 52 | 0 | 100 | 100 | 0 | 0 | 0 | 1.5 | 0.9 | 1.7 | 47 |
| 53 | 0 | 87 | 87 | 0 | 9 | 4 | 1.9 | 0.8 | 1.9 | 112 |
| 54 | 0 | 77 | 77 | 3 | 14 | 6 | 2.3 | 0.7 | 3.8 | 109 |
| 55 | 0 | 69 | 69 | 1 | 11 | 19 | 1.5 | 0.9 | 4.7 | 95 |
| 56 | 0 | 100 | 100 | 0 | 0 | 0 | 2.4 | 26.2 | 3.5 | 93 |
| 57 | 0 | 96 | 96 | 4 | 0 | 0 | 2.2 | 1.3 | 2.3 | 106 |
| 58 | 0 | 99 | 99 | 1 | 0 | 0 | 1.1 | 14.5 | 1.6 | 92 |
| 59 | 0 | 99 | 99 | 1 | 0 | 0 | 1.2 | 0.7 | 1.8 | 85 |
| 60 | 0 | 99 | 99 | 1 | 0 | 0 | 3.2 | 0.8 | 5.1 | 96 |
| 61 | 0 | 99 | 99 | 1 | 0 | 0 | 1.2 | 4.5 | 2.5 | 75 |
| 62 | 0 | 99 | 99 | 1 | 0 | 0 | 1.4 | 3.7 | 2.3 | 83 |
| 63 | 0 | 99 | 99 | 1 | 0 | 0 | 1.3 | 3.9 | 2.0 | 92 |
| 64 | 0 | 99 | 99 | 0 | 0 | 0 | 1.1 | 14.7 | 1.3 | 95 |
| 65 | 0 | 53 | 53 | 3 | 23 | 21 | 1.4 | 0.7 | 3.7 | 118 |
| 66 | 0 | 94 | 94 | 1 | 2 | 3 | 1.3 | 1.5 | 3.4 | 106 |
| 67 | 0 | 100 | 100 | 0 | 0 | 0 | 1.3 | 0.9 | 1.8 | 82 |
| 68 | 0 | 98 | 98 | 0 | 1 | 1 | 1.2 | 0.8 | 2.0 | 65 |

(Note)
An underline represents a condition outside of the range of the present invention.

TABLE 7-2

| No. | Volume fraction of microstructures: Martensite (%): Fresh martensite (%) | Martensite (%): Tempered martensite (%) | Martensite (%): Total (%) | Residual austenite (%) | Ferrite (%) | Other (%) | Prior austenite grains: Average aspect ratio | Sulfides: Proportion of sulfides having aspect ratio of more than 3 among sulfides having area of 1 μm² | Texture: Pole density of {211}<011> | ΔHv (Hv) |
|---|---|---|---|---|---|---|---|---|---|---|
| 69 | 100 | 0 | 100 | 0 | 0 | 0 | 1.1 | 0.7 | 1.5 | 57 |
| 70 | 99 | 1 | 100 | 0 | 0 | 0 | 1.5 | 0.5 | 1.8 | 53 |
| 71 | 100 | 0 | 100 | 0 | 0 | 0 | 1.3 | 0.8 | 2.1 | 62 |
| 72 | 98 | 2 | 100 | 0 | 0 | 0 | 2.0 | 0.6 | 1.7 | 55 |
| 73 | 99 | 0 | 99 | 1 | 0 | 0 | 1.8 | 0.9 | 2.3 | 55 |
| 74 | 100 | 0 | 100 | 0 | 0 | 0 | 1.4 | 0.8 | 1.6 | 65 |
| 75 | 79 | 6 | 85 | 0 | 10 | 5 | 1.8 | 0.7 | 1.8 | 123 |
| 76 | 68 | 7 | 75 | 3 | 15 | 7 | 2.1 | 0.9 | 3.5 | 121 |
| 77 | 54 | 12 | 66 | 2 | 12 | 20 | 1.6 | 0.8 | 4.2 | 105 |
| 78 | 100 | 0 | 100 | 0 | 0 | 0 | 2.5 | 23.5 | 3.7 | 105 |
| 79 | 92 | 5 | 97 | 3 | 0 | 0 | 2.3 | 1.2 | 2.5 | 116 |
| 80 | 100 | 0 | 100 | 0 | 0 | 0 | 1.2 | 12.6 | 1.7 | 103 |
| 81 | 98 | 2 | 100 | 0 | 0 | 0 | 1.3 | 0.8 | 1.6 | 95 |
| 82 | 100 | 0 | 100 | 0 | 0 | 0 | 3.1 | 0.9 | 4.8 | 107 |
| 83 | 100 | 0 | 100 | 0 | 0 | 0 | 1.3 | 3.2 | 2.3 | 87 |
| 84 | 100 | 0 | 100 | 0 | 0 | 0 | 1.4 | 3.5 | 2.1 | 94 |
| 85 | 99 | 1 | 100 | 0 | 0 | 0 | 1.2 | 3.3 | 2.2 | 104 |
| 86 | 100 | 0 | 100 | 0 | 0 | 0 | 1.2 | 13.6 | 1.4 | 105 |
| 87 | 35 | 18 | 53 | 2 | 25 | 20 | 1.2 | 0.8 | 3.2 | 130 |
| 88 | 77 | 15 | 92 | 2 | 3 | 3 | 1.5 | 1.7 | 3.5 | 116 |

(Note)
An underline represents a condition outside of the range of the present invention.

TABLE 7-3

| | Mechanical properties | | | | | | | | | | | |
|---|---|---|---|---|---|---|---|---|---|---|---|---|
| | Tensile strength (TS) (MPa) | | | Total elongation (EL) (%) | | | vE-40° C.(J/cm$^2$) | | | | | |
| No. | L direction | C direction | TS(L)/TS(C) | L direction | C direction | EL(L)/EL(C) | L direction | C direction | vE-40° C.(L)/vE-40° C.(C) | Hole expansion ratio (λ) | TS × λ (MPa · %) | Note |
| 47 | 1002 | 1012 | 0.99 | 14.2 | 13.9 | 1.02 | 90 | 87 | 1.03 | 60 | 60720 | Examples |
| 48 | 1052 | 1105 | 0.95 | 12.6 | 12.2 | 1.03 | 76 | 73 | 1.04 | 56 | 61880 | |
| 49 | 997 | 1016 | 0.98 | 12.4 | 12.1 | 1.02 | 75 | 72 | 1.04 | 60 | 60960 | |
| 50 | 1140 | 1161 | 0.98 | 13 5 | 12.9 | 1.05 | 84 | 80 | 1.05 | 53 | 61533 | |
| 51 | 1212 | 1225 | 0.99 | 11.9 | 11.6 | 1.03 | 75 | 71 | 1.06 | 49 | 60025 | |
| 52 | 1017 | 1039 | 0.98 | 12.7 | 12.4 | 1.02 | 79 | 77 | 1.03 | 59 | 61301 | |
| 53 | 738 | 792 | 0.93 | 11.8 | 11.1 | 1.06 | 72 | 68 | 1.06 | 41 | 32472 | Comparative examples |
| 54 | 756 | 875 | 0.86 | 12.5 | 11.1 | 1.13 | 71 | 57 | 1.25 | 36 | 31500 | |
| 55 | 758 | 867 | 0.87 | 12.6 | 11.4 | 1.11 | 69 | 61 | 1.13 | 34 | 29478 | |
| 56 | 876 | 1112 | 0.79 | 12.3 | 9.9 | 1.24 | 57 | 30 | 1.90 | 29 | 32248 | |
| 57 | 1322 | 1441 | 0.92 | 10.8 | 9.8 | 1.10 | 62 | 49 | 1.27 | 24 | 34584 | |
| 58 | 984 | 992 | 0.99 | 13.5 | 11.8 | 1.14 | 79 | 70 | 1.13 | 29 | 28768 | |
| 59 | 938 | 953 | 0.98 | 13.1 | 12.9 | 1.02 | 44 | 39 | 1.13 | 33 | 31449 | |
| 60 | 985 | 1061 | 0.93 | 13.2 | 11.9 | 1.11 | 76 | 68 | 1.12 | 30 | 31830 | |
| 61 | 958 | 980 | 0.98 | 13.5 | 12.9 | 1.05 | 60 | 45 | 1.33 | 31 | 30380 | |
| 62 | 943 | 962 | 0.98 | 13.4 | 12.7 | 1.06 | 58 | 44 | 1.32 | 32 | 30784 | |
| 63 | 961 | 982 | 0.98 | 13.2 | 12.7 | 1.04 | 46 | 35 | 1.31 | 34 | 33388 | |
| 64 | 963 | 986 | 0.98 | 13.5 | 12.0 | 1.13 | 83 | 57 | 1.46 | 32 | 31552 | |
| 65 | 702 | 752 | 0.93 | 12.4 | 11.2 | 1.11 | 70 | 59 | 1.19 | 39 | 29328 | |
| 66 | 845 | 903 | 0.94 | 11.5 | 10.4 | 1.11 | 71 | 60 | 1.18 | 37 | 33411 | |
| 67 | 885 | 992 | 0.89 | 13.6 | 13.4 | 1.01 | 87 | 84 | 1.04 | 39 | 38688 | |
| 68 | 960 | 971 | 0.99 | 12.1 | 11.9 | 1.02 | 54 | 50 | 1.08 | 38 | 36898 | |

(Note)
An underline represents a condition outside of the range of the present invention.

TABLE 7-4

| | Mechanical properties | | | | | | | | | | | |
|---|---|---|---|---|---|---|---|---|---|---|---|---|
| | Tensile strength (TS) (MPa) | | | Total elongation (EL) (%) | | | vE-40° C.(J/cm$^2$) | | | | | |
| No. | L direction | C direction | TS(L)/TS(C) | L direction | C direction | EL(L)/EL(C) | L direction | C direction | vE-40° C.(L)/vE-40° C.(C) | Hole expansion ratio (λ) | TS × λ (MPa · %) | Note |
| 69 | 1189 | 1200 | 0.99 | 12.9 | 12.7 | 1.02 | 75 | 72 | 1.04 | 41 | 49200 | Examples |
| 70 | 1232 | 1277 | 0.96 | 11.4 | 110 | 1.04 | 63 | 60 | 1.05 | 38 | 48526 | |
| 71 | 1185 | 1204 | 0.98 | 11.3 | 11.2 | 1.01 | 65 | 63 | 1.03 | 40 | 48160 | |
| 72 | 1339 | 1360 | 0.98 | 12.4 | 11.8 | 1.05 | 80 | 76 | 1.05 | 35 | 47600 | |
| 73 | 1470 | 1485 | 0.99 | 10.8 | 10.4 | 1.04 | 62 | 60 | 1.03 | 30 | 44550 | |
| 74 | 1205 | 1228 | 0.98 | 11.4 | 11.1 | 1.03 | 67 | 64 | 1.05 | 39 | 47892 | |
| 75 | 918 | 976 | 0.94 | 10.8 | 10.1 | 1.07 | 69 | 65 | 1.06 | 28 | 27328 | Comparative examples |
| 76 | 953 | 1072 | 0.89 | 11.5 | 10.1 | 1.14 | 65 | 52 | 1.25 | 21 | 22512 | |
| 77 | 935 | 1057 | 0.88 | 11.8 | 10.5 | 1.12 | 59 | 51 | 1.16 | 20 | 21140 | |
| 78 | 1186 | 1326 | 0.89 | 11.2 | 9.2 | 1.22 | 52 | 25 | 2.08 | 16 | 21216 | |
| 79 | 1532 | 1652 | 0.93 | 10.1 | 9.2 | 1.10 | 51 | 45 | 1.13 | 14 | 23128 | |
| 80 | 1180 | 1192 | 0.99 | 12.8 | 11.0 | 1.16 | 74 | 64 | 1.16 | 15 | 17880 | |
| 81 | 1136 | 1152 | 0.99 | 12.3 | 12.4 | 0.99 | 31 | 27 | 1.15 | 19 | 21888 | |
| 82 | 1192 | 1272 | 0.94 | 12.1 | 10.5 | 1.15 | 72 | 65 | 1.11 | 15 | 19080 | |
| 83 | 1172 | 1193 | 0.98 | 12.6 | 11.9 | 1.06 | 56 | 45 | 1.24 | 18 | 21474 | |
| 84 | 1165 | 1187 | 0.98 | 12.4 | 11.8 | 1.05 | 55 | 47 | 1.17 | 18 | 21366 | |
| 85 | 1179 | 1197 | 0.98 | 12.2 | 11.6 | 1.05 | 48 | 42 | 1.14 | 19 | 22743 | |
| 86 | 1176 | 1197 | 0.98 | 12.9 | 11.3 | 1.14 | 75 | 51 | 1.47 | 18 | 21546 | |
| 87 | 876 | 932 | 0.94 | 11.4 | 10.2 | 1.12 | 62 | 52 | 1.19 | 31 | 28892 | |
| 88 | 1026 | 1085 | 0.95 | 10.3 | 9.3 | 1.11 | 65 | 54 | 1.20 | 27 | 29295 | |

(Note)
An underline represents a condition outside of the range of the present invention.

It can be seen from Tables 1-1 to 7-4 that, in all of the steel sheets according to the examples, the desired properties were able to be obtained. On the other hand, it can be seen that, in the comparative examples where the chemical composition or the manufacturing method was outside of the range of the present invention, one or more properties were poor.

The invention claimed is:

1. A hot-rolled steel sheet comprising, as a chemical composition, by mass %:

C: 0.08% to 0.25%;

Si: 0.01% to 1.00%;

Mn: 0.8% to 2.0%;

P: 0.020% or less;

S: 0.001% to 0.010%;
Al: 0.005% to 1.000%;
N: 0.0010% to 0.0100%;
Ti: 0.005% to 0.30%;
Ca: 0.0005% to 0.0100%;
Nb: 0% to 0.30%;
V: 0% to 0.50%;
Cr: 0% to 3.0%;
Mo: 0% to 3.0%;
Ni: 0% to 5.0%;
Cu: 0% to 3.0%;
B: 0% to 0.0100%;
Mg: 0% to 0.0100%;
Zr: 0% to 0.0500%;
REM: 0% to 0.050%; and
a remainder including Fe and impurities,
wherein a microstructure includes 99% or more of martensite by volume fraction and a remainder in microstructure including residual austenite and ferrite, wherein the martensite refers to one or more of fresh martensite and tempered martensite,
in a cross section parallel to a rolling direction,
an average aspect ratio of prior austenite grains is less than 3.0,
a proportion of sulfides having an aspect ratio of more than 3.0 among sulfides having an area of 1.0 $\mu m^2$ or more is 1.0% or less, and
in a thickness middle portion, a pole density of {211}<011> orientation is 3.0 or less, and
a tensile strength TS is 980 MPa or higher.

2. The hot-rolled steel sheet according to claim 1,
wherein the tensile strength TS is 1180 MPa or higher.

3. The hot-rolled steel sheet according to claim 1,
wherein, in a cross section perpendicular to the rolling direction, a difference ΔHv between a maximum value and a minimum value of Vickers hardness is 50 or less.

4. The hot-rolled steel sheet according to claim 1, further comprising a galvanized layer on a surface.

5. The hot-rolled steel sheet according to claim 1,
wherein the chemical composition includes, by mass %, one or more of:
Nb: 0.005% to 0.30%;
V: 0.01% to 0.50%;
Cr: 0.05% to 3.0%;
Mo: 0.05% to 3.0%;
Ni: 0.05% to 5.0%;
Cu: 0.10% to 3.0%;
B: 0.0003% to 0.0100%;
Mg: 0.0005% to 0.0100%;
Zr: 0.0010% to 0.0500%; and
REM: 0.0010% to 0.050%.

6. The hot-rolled steel sheet according to claim 2,
wherein a volume fraction of tempered martensite is less than 5%.

7. The hot-rolled steel sheet according to claim 2, further comprising a galvanized layer on a surface.

8. The hot-rolled steel sheet according to claim 2,
wherein the chemical composition includes, by mass %, one or more of:
Nb: 0.005% to 0.30%;
V: 0.01% to 0.50%;
Cr: 0.05% to 3.0%;
Mo: 0.05% to 3.0%;
Ni: 0.05% to 5.0%;
Cu: 0.10% to 3.0%;
B: 0.0003% to 0.0100%;
Mg: 0.0005% to 0.0100%;
Zr: 0.0010% to 0.0500%; and
REM: 0.0010% to 0.050%.

9. The hot-rolled steel sheet according to claim 3,
wherein a volume fraction of fresh martensite is less than 3%.

10. The hot-rolled steel sheet according to claim 3, further comprising a galvanized layer on a surface.

11. The hot-rolled steel sheet according to claim 3,
wherein the chemical composition includes, by mass %, one or more of:
Nb: 0.005% to 0.30%;
V: 0.01% to 0.50%;
Cr: 0.05% to 3.0%;
Mo: 0.05% to 3.0%;
Ni: 0.05% to 5.0%;
Cu: 0.10% to 3.0%;
B: 0.0003% to 0.0100%;
Mg: 0.0005% to 0.0100%;
Zr: 0.0010% to 0.0500%; and
REM: 0.0010% to 0.050%.

12. The hot-rolled steel sheet according to claim 4,
wherein the galvanized layer is a galvannealed layer.

13. The hot-rolled steel sheet according to claim 6, further comprising a galvanized layer on a surface.

14. The hot-rolled steel sheet according to claim 6,
wherein the chemical composition includes, by mass %, one or more of:
Nb: 0.005% to 0.30%;
V: 0.01% to 0.50%;
Cr: 0.05% to 3.0%;
Mo: 0.05% to 3.0%;
Ni: 0.05% to 5.0%;
Cu: 0.10% to 3.0%;
B: 0.0003% to 0.0100%;
Mg: 0.0005% to 0.0100%;
Zr: 0.0010% to 0.0500%; and
REM: 0.0010% to 0.050%.

15. The hot-rolled steel sheet according to claim 9, further comprising a galvanized layer on a surface.

16. The hot-rolled steel sheet according to claim 9,
wherein the chemical composition includes, by mass %, one or more of:
Nb: 0.005% to 0.30%;
V: 0.01% to 0.50%;
Cr: 0.05% to 3.0%;
Mo: 0.05% to 3.0%;
Ni: 0.05% to 5.0%;
Cu: 0.10% to 3.0%;
B: 0.0003% to 0.0100%;
Mg: 0.0005% to 0.0100%;
Zr: 0.0010% to 0.0500%; and
REM: 0.0010% to 0.050%.

17. A method of manufacturing the hot-rolled steel sheet according to claim 1, comprising:
a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities;

a hot rolling process of hot-rolling the cast slab after the heating process to obtain a hot-rolled steel sheet; and a coiling process of coiling the hot-rolled steel sheet after the hot rolling process in a temperature range of 100° C. or lower, wherein, in the hot rolling process, the cast slab is rolled with a finish rolling temperature of 1000° C. or higher, a first cooling is performed wherein a time from finish rolling completion temperature to start of cooling is within 0.10 seconds and a temperature decrease at an average cooling rate of 100° C./sec or faster is 50° C. or higher, a light reduction rolling where a rolling reduction is 5% or more and 20% or less is performed at a temperature of an Ar3 transformation point or higher after the first cooling, and a second cooling is performed wherein an average cooling rate from light reduction rolling completion temperature to 200° C. or lower is 50° C./sec or faster.

18. A method of manufacturing the hot-rolled steel sheet according to claim 3, comprising:

a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities;

a hot rolling process of hot-rolling the cast slab after the heating process to obtain a hot-rolled steel sheet;

a coiling process of coiling the hot-rolled steel sheet after the hot rolling process in a temperature range of 100° C. or lower;

a temper rolling process of performing temper rolling at an elongation ratio of 0.7% or more on the hot-rolled steel sheet after the coiling process; and a tempering process of performing tempering where the hot-rolled steel sheet is heated up to 430° C. to 560° C. after the temper rolling, wherein, in the hot rolling process, the cast slab is rolled with a finish rolling temperature of 1000° C. or higher, a first cooling is performed wherein a time from finish rolling completion temperature to start of cooling is within 0.10 seconds and a temperature decrease at an average cooling rate of 100° C./sec or faster is 50° C. or higher, a light reduction rolling where a rolling reduction is 5% or more and 20% or less is performed at a temperature of an Ar3 transformation point or higher after the first cooling, and a second cooling is performed wherein an average cooling rate from light reduction rolling completion temperature to 200° C. or lower is 50° C./sec or faster.

19. A method of manufacturing the hot-rolled steel sheet according to claim 4, comprising:

a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities;

a hot rolling process of hot-rolling the cast slab after the heating process to obtain a hot-rolled steel sheet;

a coiling process of coiling the hot-rolled steel sheet after the hot rolling process in a temperature range of 100° C. or lower;

a temper rolling process of performing temper rolling at an elongation ratio of 0.7% or more on the hot-rolled steel sheet after the coiling process; and a galvanizing process of performing Ni pre-plating on the hot-rolled steel sheet, heating the hot-rolled steel sheet up to 430° C. to 480° C. at a temperature rising rate of 20° C./sec or faster, and galvanizing the hot-rolled steel sheet, wherein, in the hot rolling process, the cast slab is rolled with a finish rolling temperature of 1000° C. or higher, a first cooling is performed wherein a time from finish rolling completion temperature to start of cooling is within 0.10 seconds and a temperature decrease at an average cooling rate of 100° C./sec or faster is 50° C. or higher, a light reduction rolling where a rolling reduction is 5% or more and 20% or less is performed at a temperature of an Ar3 transformation point or higher after the first cooling, and a second cooling is performed wherein an average cooling rate from light reduction rolling completion temperature to 200° C. or lower is 50° C./sec or faster.

20. A method of manufacturing the hot-rolled steel sheet according to claim 12, comprising:

a heating process of heating a cast slab to 1350° C. or higher and 1400° C. or lower directly or after being temporarily cooled, the cast slab including, as a chemical composition, by mass %, C: 0.08% to 0.25%, Si: 0.01% to 1.00%, Mn: 0.8% to 2.0%, P: 0.020% or less, S: 0.001% to 0.010%, Al: 0.005% to 1.000%, N: 0.0010% to 0.0100%, Ti: 0.005% to 0.30%, Ca: 0.0005% to 0.0100%, Nb: 0% to 0.30%, V: 0% to 0.50%, Cr: 0% to 3.0%, Mo: 0% to 3.0%, Ni: 0% to 5.0%, Cu: 0% to 3.0%, B: 0% to 0.0100%, Mg: 0% to 0.0100%, Zr: 0% to 0.0500%, REM: 0% to 0.050%, and a remainder including Fe and impurities;

a hot rolling process of hot-rolling the cast slab after the heating process to obtain a hot-rolled steel sheet;

a coiling process of coiling the hot-rolled steel sheet after the hot rolling process in a temperature range of 100° C. or lower;

a temper rolling process of performing temper rolling at an elongation ratio of 0.7% or more on the hot-rolled steel sheet after the coiling process;

a galvanizing process of performing Ni pre-plating on the hot-rolled steel sheet, heating the hot-rolled steel sheet up to 430° C. to 480° C. at a temperature rising rate of 20° C./sec or faster, and galvanizing the hot-rolled steel sheet; and an alloying process of performing alloying at 470° C. to 560° C. for 10 seconds to 40 seconds after the galvanizing process, wherein, in the hot rolling process, the cast slab is rolled with a finish rolling temperature of 1000° C. or higher, a first cooling is performed wherein a time from finish rolling completion temperature to start of cooling is within 0.10 seconds and a temperature decrease at an average cooling rate of 100° C./sec or faster is 50° C. or higher, a light reduction rolling where a rolling reduction is 5% or more and 20% or less is performed at a temperature of an Ar3 transformation point or higher after the first cooling, and a second cooling is performed wherein an average cooling rate from light reduction rolling completion temperature to 200° C. or lower is 50° C./sec or faster.

* * * * *